US009234721B2

(12) United States Patent
Hines

(10) Patent No.: US 9,234,721 B2
(45) Date of Patent: Jan. 12, 2016

(54) CONE GRIP FOR HANDGUN

(71) Applicant: Steve Hines, Edgewood, NM (US)

(72) Inventor: Steve Hines, Edgewood, NM (US)

(73) Assignee: Falcon Industries, Inc., Edgewood, NM (US)

( * ) Notice: Subject to any disclaimer, the term of this patent is extended or adjusted under 35 U.S.C. 154(b) by 0 days.

(21) Appl. No.: 14/593,134

(22) Filed: Jan. 9, 2015

(65) Prior Publication Data

US 2015/0192386 A1 Jul. 9, 2015

Related U.S. Application Data

(63) Continuation of application No. 29/478,902, filed on Jan. 9, 2014, now Pat. No. Des. 734,418.

(60) Provisional application No. 61/925,451, filed on Jan. 9, 2014.

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41C 23/10; F41A 17/066; F41A 17/20; F41A 17/02
USPC ..... 42/71.02, 71.01, 72
See application file for complete search history.

(56) References Cited

U.S. PATENT DOCUMENTS

| | | | | |
|---|---|---|---|---|
| 3,128,571 | A * | 4/1964 | Herrett | F41C 23/10 42/71.02 |
| 6,487,804 | B1 * | 12/2002 | Petrella, Jr. | F41A 17/06 42/70.08 |
| 2008/0289237 | A1 * | 11/2008 | Pikielny | F41A 17/066 42/70.11 |
| 2010/0214470 | A1 * | 8/2010 | Cottagnoud | G05G 1/06 348/376 |
| 2011/0167698 | A1 * | 7/2011 | Hoguc | F41C 23/10 42/71.02 |
| 2013/0019510 | A1 * | 1/2013 | Kemmerer | F41A 17/20 42/1.01 |
| 2013/0019512 | A1 * | 1/2013 | Kemmerer | F41A 17/066 42/70.05 |
| 2013/0125441 | A1 * | 5/2013 | Westwood | F41A 17/02 42/70.05 |

* cited by examiner

*Primary Examiner* — Michael David
(74) *Attorney, Agent, or Firm* — Richard H. Krukar; Luis M. Ortiz; Kermit D Lopez

(57) ABSTRACT

An ergonomic grip for a revolver can be better suited to people's hands by extending the forward edge of the finger interface forward to near the lower portion of the trigger guard. The palm interface and the finger interface can intersect or nearly intersect at the bottom of the grip. The grip has a substantially cone shaped cross-section.

15 Claims, 55 Drawing Sheets

CONE GRIP FOR HANDGUN

CROSS REFERENCE TO RELATED APPLICATIONS

This application claims the benefit and priority of U.S. Provisional Patent Application 61/925,451 titled "Cone Grip for Handgun" and filed on Jan. 9, 2014 and is a continuation of U.S. patent application Ser. No. 29/478,902 titled "Firearm Grip" and filed on Jan. 9, 2014 both of which are herein incorporated by reference in their entirety.

TECHNICAL FIELD

Embodiments relate to the fields of small arms, handguns, and handgun grips.

BACKGROUND

Standard handgun grips, particularly revolver grips, must be held in a manner that often leads to discomfort and higher sensitivity to recoil. This is particularly true when the operators hand is large in comparison to the grip size. Systems and methods for providing a more ergonomic grip are needed.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

Systems and methods are needed for providing a more ergonomic revolver grip. The needed grip can be obtained by use of a cone grip that mounts on a revolver frame in place of a standard revolver grip.

It is therefore an aspect of the embodiments to provide a grip for a revolver. The revolver has a frame with a trigger guard and a grip area. The grip area includes the frames base, palm strap, and typical finger interface. The grip includes a left overmold, left substrate, right substrate, and right overmold. The left substrate fits into the left substrate to form the left half of the grip. The right substrate fits into the right overmold to form the right half of the grip. The left half and the right half can be fastened together with the grip area between them to thereby install the grip on the revolver.

It is another aspect of the embodiments that the grip fills the large gap between the typical finger interface and the trigger guard. To accomplish this, the grip can contact the trigger guard or the finger interface forward edge can lie underneath at least some portion of the trigger guard.

It is yet another aspect of certain embodiments to have a finger interface with finger grooves. A possible side effect of filling the large gap is that one or more of the finger groves can be located within or under the large gap.

It is a further aspect of the embodiments that the palm interface and the finger interface are closer together at the bottom of the grip than the top of the grip such that the grip has a substantially conical cross-section. Certain embodiments can have the finger interlace and the palm interface intersecting.

BRIEF DESCRIPTION OF THE DRAWINGS

The accompanying figures, in which like names (reference numerals in utility) refer to identical or functionally similar elements throughout the separate views and which are incorporated in and form a part of the specification, further illustrate the present invention and, together with the background of the invention, brief summary of the invention, and detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof. In general, the figures are not to scale.

A handgun grip 102 having a left side and a right side and that provides finger grooves 104 and a somewhat conical shape can provide a more ergonomic and controllable grip for a revolver. Each grip half has a substrate and an overmold with the substrate being a rigid plastic that provides structural rigidity and the overmold being a softer plastic that provides an ergonomic gripping surface and form. The two halves can be positioned over a firearm frame and secured there with fasteners such as a machine screw 105 and a threaded insert.

Figure 1:
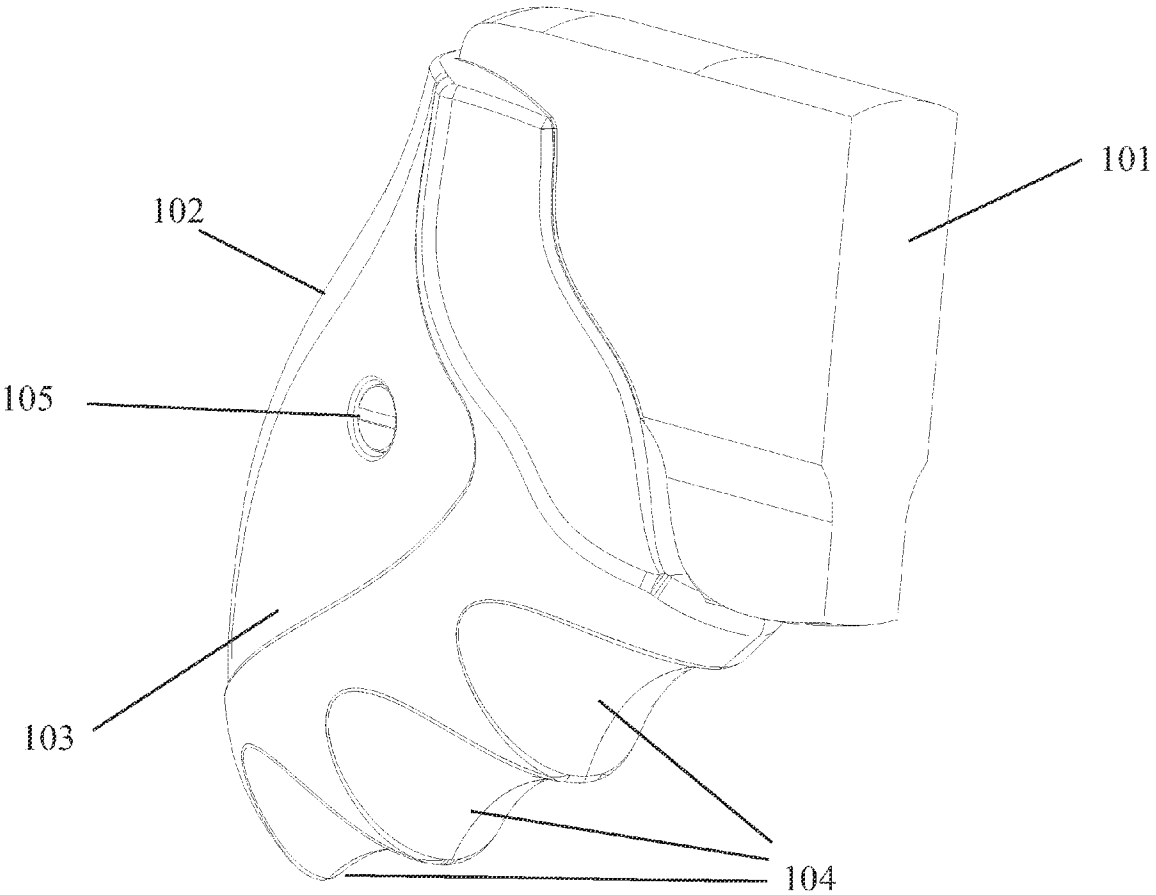
FIG. 1 illustrates a right side front view of a cone grip mounted on a revolver frame form in accordance with aspects of the embodiments.

FIG. 1 illustrates a right side front view of a cone grip 102 mounted on a revolver frame form 101 in accordance with aspects of the embodiments. The right overmold 103 can be seen with a machine screw 105 attaching the right side of the grip to the left side. The generally conical shape of the grip 102 can be seen as can the finger grooves 104.

The frame form 101 is used in the illustrations as a stand in for a revolver frame 101, which are herein treated as equivalents. It is understood that the frame form 101 is dimensioned the same as a revolver frame 101. A frame form 101 is typically used for ease of presentation and shipping because the frame form 101 is not a firearm and therefor requires no special licensing or handling. The cone grip 102 is designed to fit on a firearm.

Figure 2:
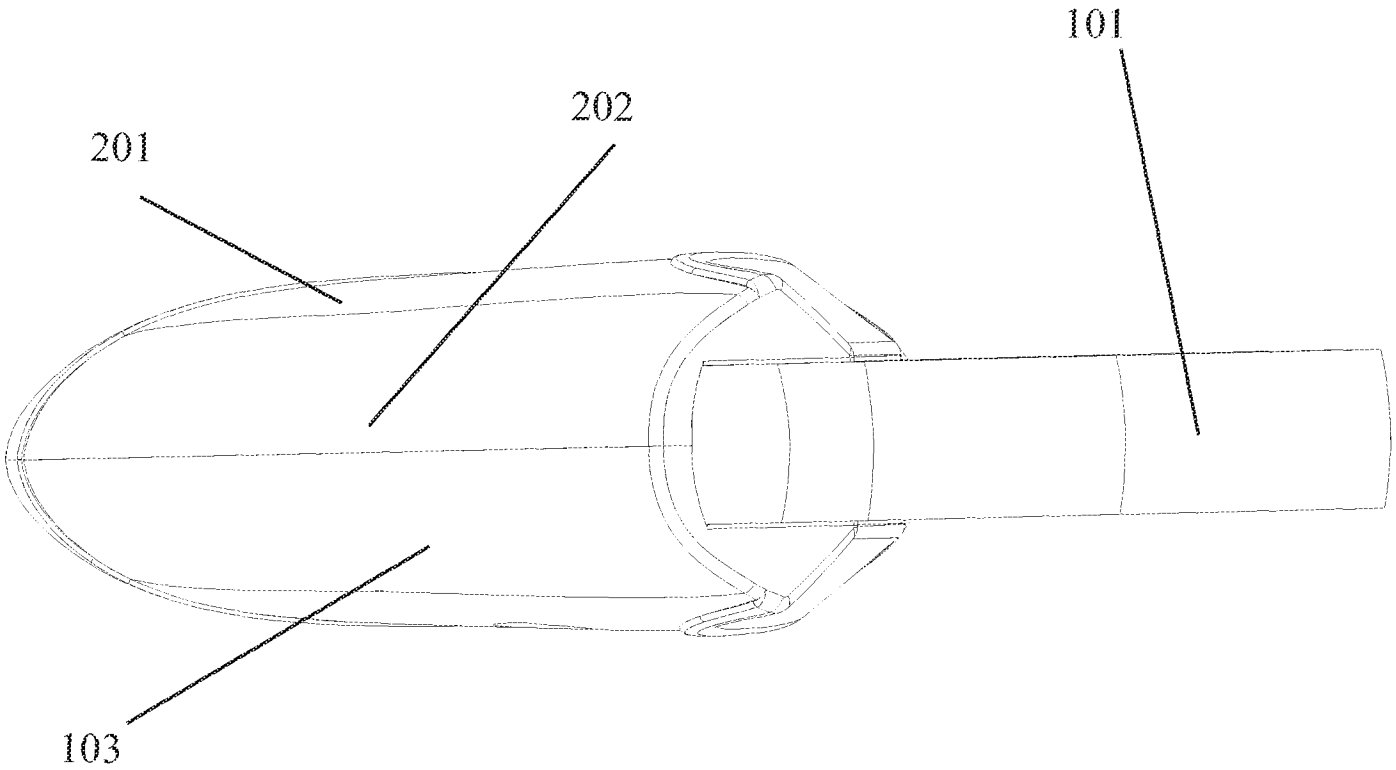
FIG. 2 illustrates a top view of a cone grip mounted on a revolver frame form in accordance with aspects of the embodiments.

FIG. 2 illustrates a top view of a cone grip 102 mounted on a revolver frame form 101 in accordance with aspects of the embodiments. The left overmold 201 and the right overmold 103 can be seen with the revolver frame 101 between them, The palm interface 202 is the back side area where the palm of the operators hand lies while operating the firearm.

Figure 3:
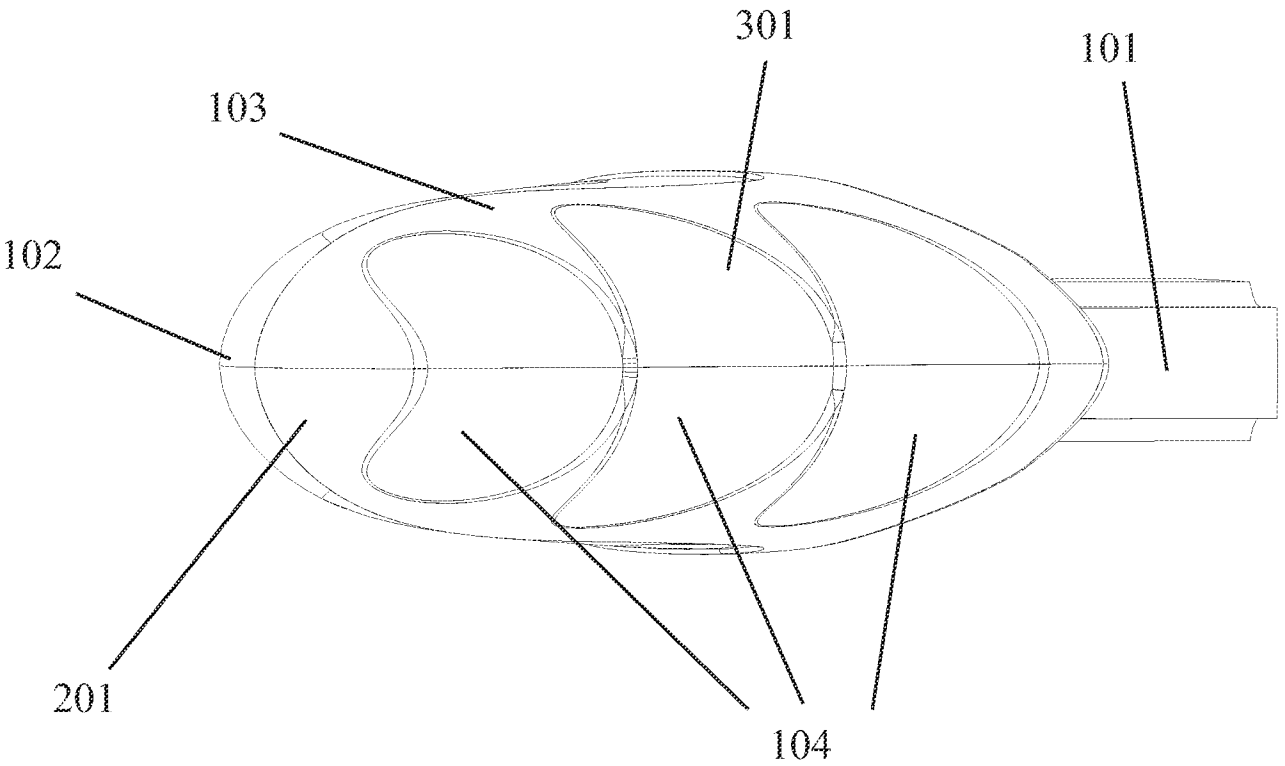
FIG. 3 illustrates a bottom view of a cone grip mounted on a revolver frame form in accordance with aspects of the embodiments.

FIG. 3 illustrates a bottom view of a cone grip 102 mounted on a revolves frame form 101 in accordance with aspects of the embodiments. The left overmold 201 and the right overmold 103 can be seen with the firearm frame 101 between them. The finger grooves help position the operators fingers while gripping the firearm. The finger interface 301 is the front side area where the operator's fingers, other than the index finger, grip the firearm.

Figure 4:
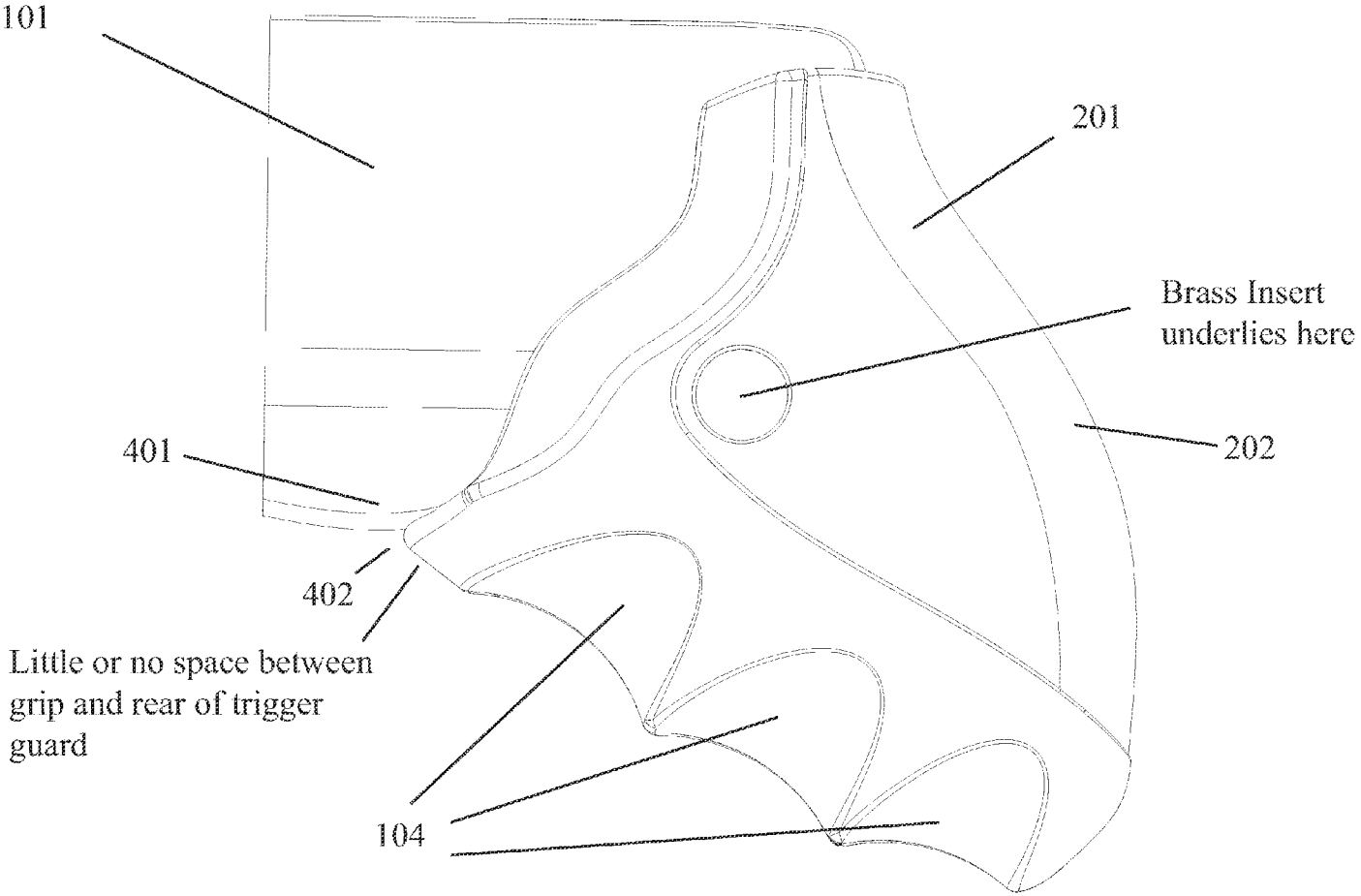
FIG. 4 illustrates a left side view of a cone grip mounted on a revolver frame form in accordance with aspects of the embodiments.

FIG. 4 illustrates a left side view of a cone grip 102 mounted on a revolver frame form 101 in accordance with aspects of the embodiments. The left overmold 201, which includes the left portion of the palm interface 202 and finger interface 301, can be seen. The grip 102 can be seen to fill the area directly behind the trigger guard and therefor extends much further forward than other styles of grip. In fact, certain embodiments can have the forward edge 402 of the finger interface 301 lying directly under the firearm trigger or even slightly in front of the firearm trigger. Another aspect is that the finger interface 301 and the palm interface 202 extend downward in smooth curves to nearly meet each other near the bottom of the grip 102. It is therefore an aspect of the cone grip 102 to have no base but instead have a transition between the finger interface 301 and palm interface 202. Other styles of revolver grip can have a large and essentially flat base area at the bottom.

Figure 5:
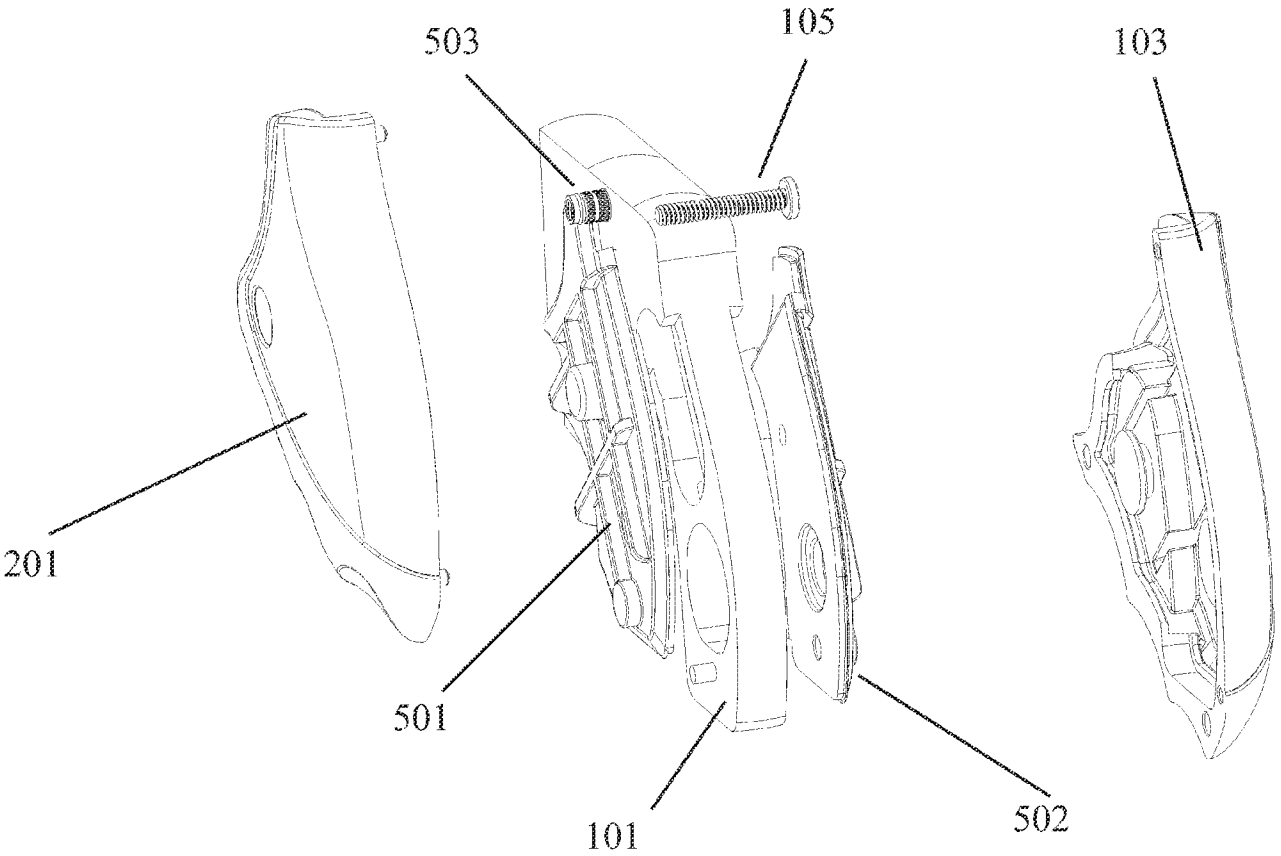
FIG. 5 illustrates a back left exploded view of a cone grip and a revolver frame form in accordance with aspects of the embodiments.

FIG. 5 illustrates a back left exploded view of a cone grip 102 and a revolver frame form 101 in accordance with aspects of the embodiments. The illustrated grip embodiments have six parts that fit together and onto a revolver frame 101. Those parts include a left overmold 201, a left substrate 501, a right substrate 502, and a right overmold 103. A machine screw 105 and brass insert 503 can attach the grip 102 to a firearm.

Figure 6:
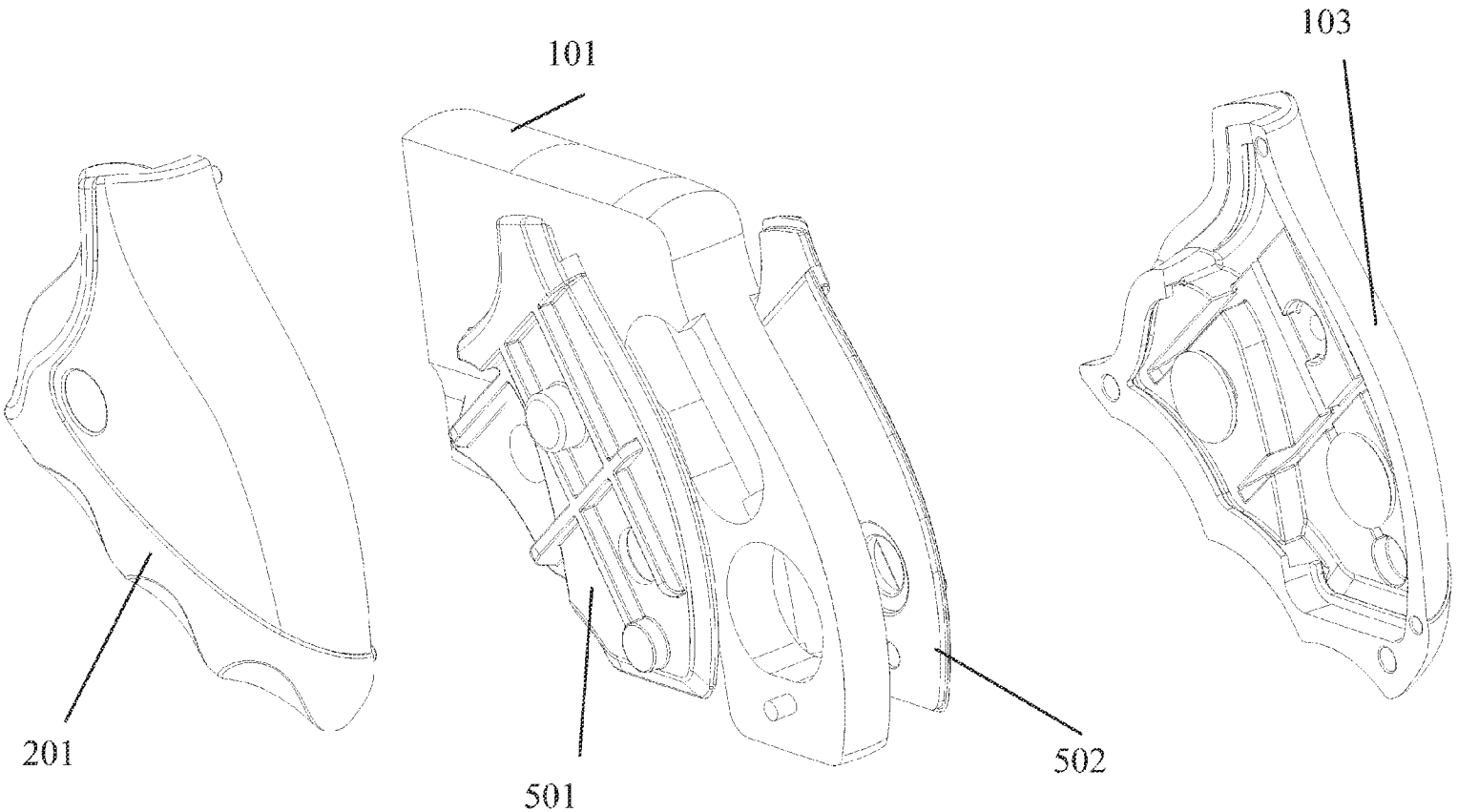
FIG. 6 illustrates another back left exploded view of a cone grip and a revolver frame form in accordance with aspects of the embodiments.

FIG. 6 illustrates another back left exploded view of a cone grip 102 and a revolver frame form 101 in accordance with aspects of the embodiments. The difference between FIG. 5 and FIG. 6 is that the viewing angle has shifted further to the left and the machine screw 105 and brass insert 503 are not shown.

Figure 7:
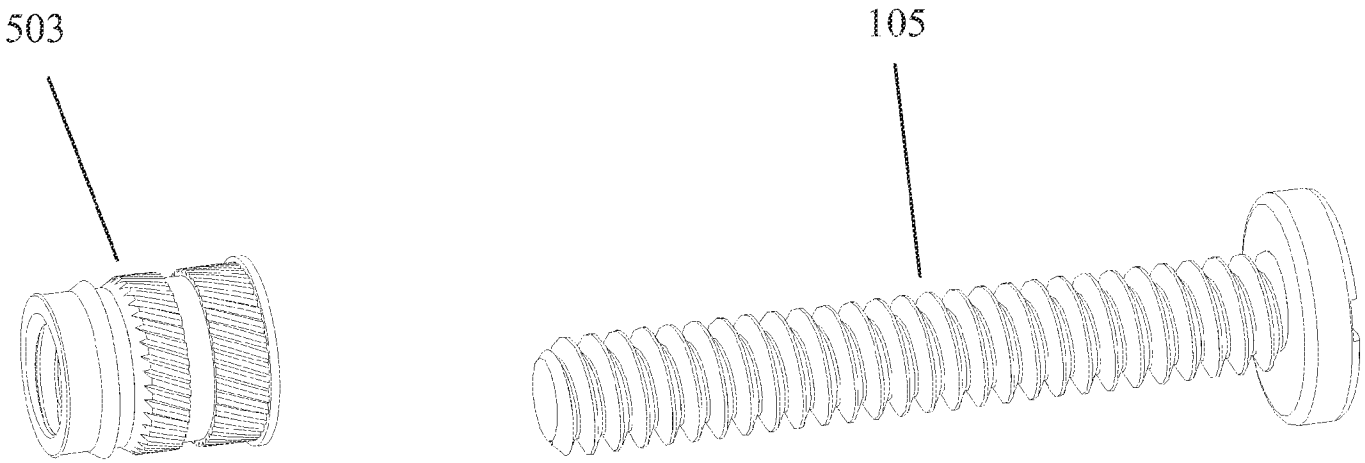
FIG. 7, which shows prior art, illustrates a machine screw and brass insert.
Figure 8:
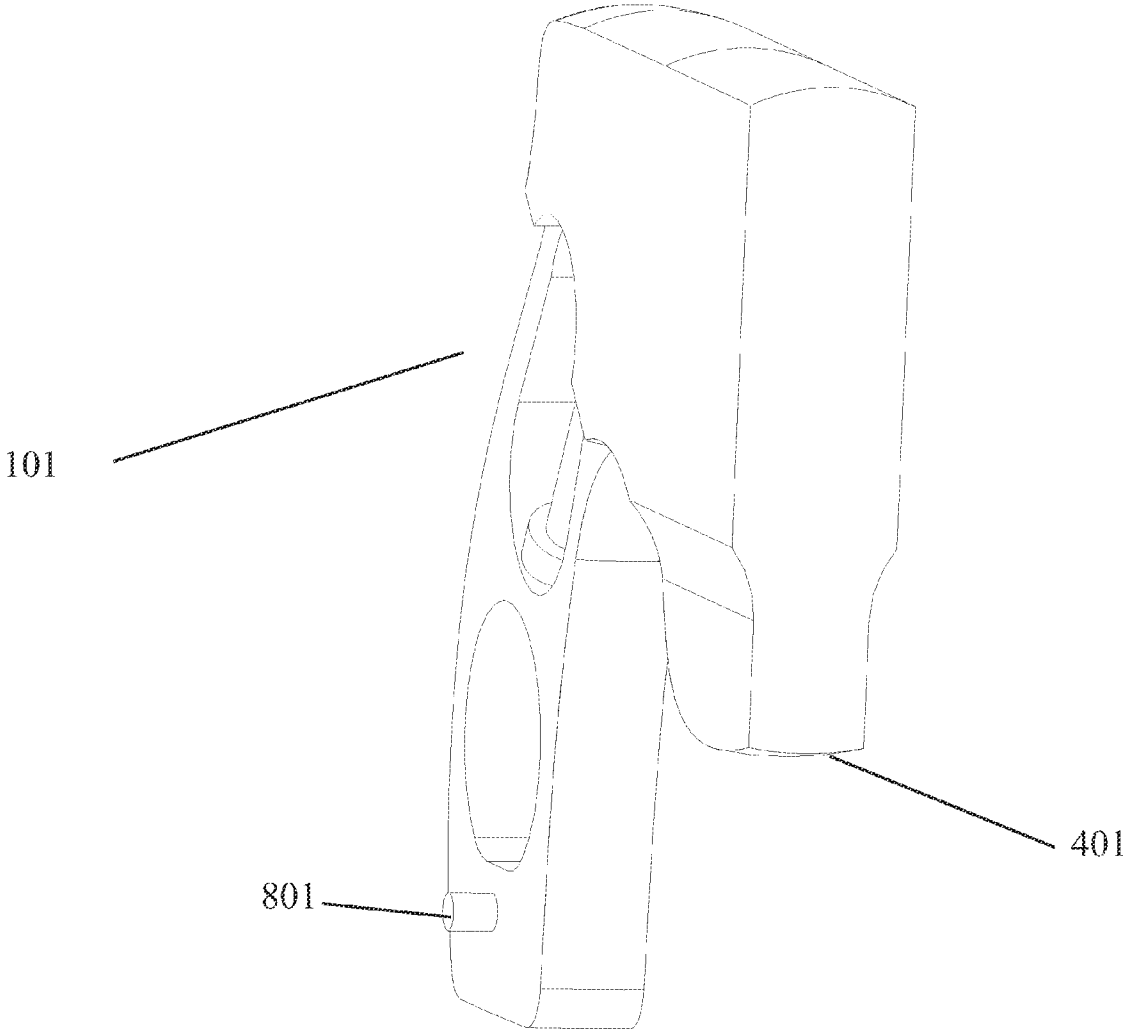
FIG. 8, which shows prior art, illustrates a right front view of a revolver frame form.
Figure 9:
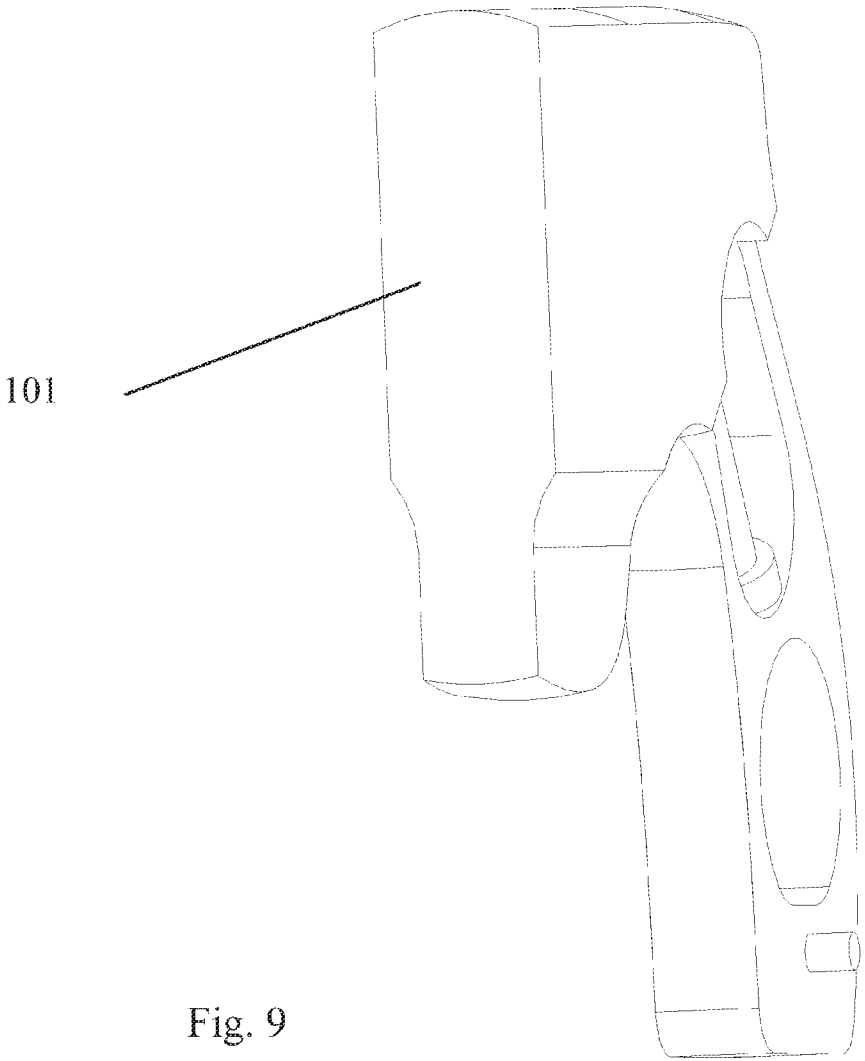
FIG. 9, which shows prior art, illustrates a left front view of a revolver frame form.
Figure 10:
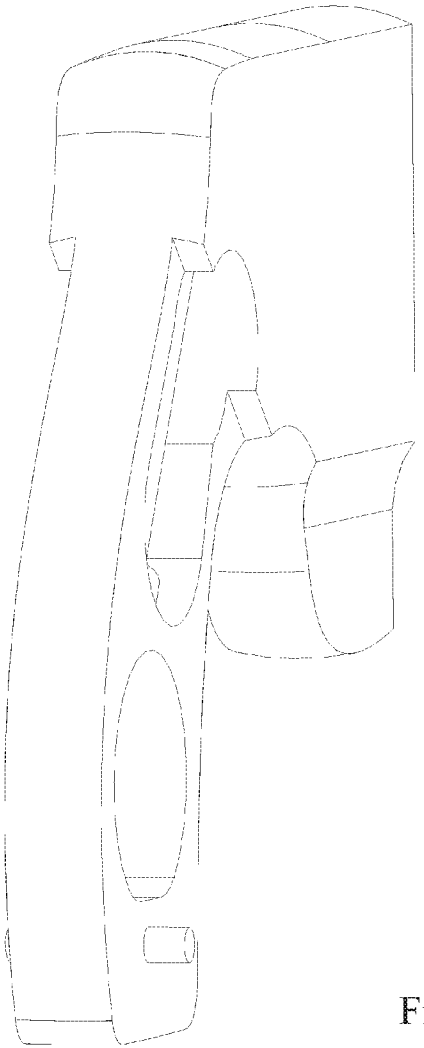
FIG. 10, which shows prior art, illustrates a right back view of a revolver frame form.
Figure 11:
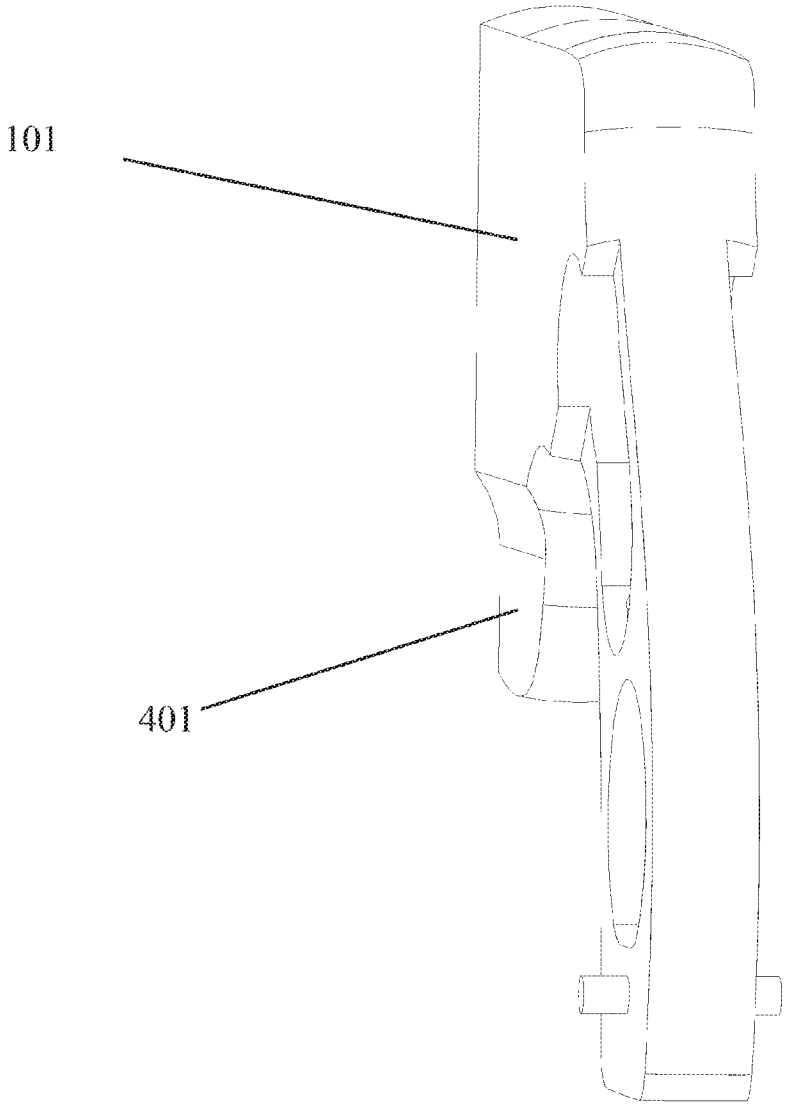
FIG. 11, which shows prior art, lustrates a left back view of a revolver frame form.

FIG. 7, which shows prior art, illustrates a machine screw 105 and brass insert 503. A brass insert 503 that is threaded to receive the machine screw 105 is taught here because it reduces the likelihood of galling or seizing with the non-brass, typically steel or iron, machine screw 105. In practice, other materials can be used including plastic. The brass insert 503 can be pressed into a proper receptacle in one grip half. The machine screw 105, after passing through the other grip half and the firearm, can be threaded in the brass insert 503 to fasten the grip 102 to the firearm. Other alternatives include molding or tapping threads directly into one of the substrates to thereby remove the need for an insert.

FIGS. 8-15, which show prior art, illustrate views of a revolver frame form 101. The trigger guard area 401 is clearly indicated. Another aspect of the illustrated frame form 101 is that there are two frame studs 801 on either side of the lower frame. The illustrated frame studs 801 mimic the frame studs 801 in certain well known revolvers and are used to help fasten and align firearm grips.

Figure 12:
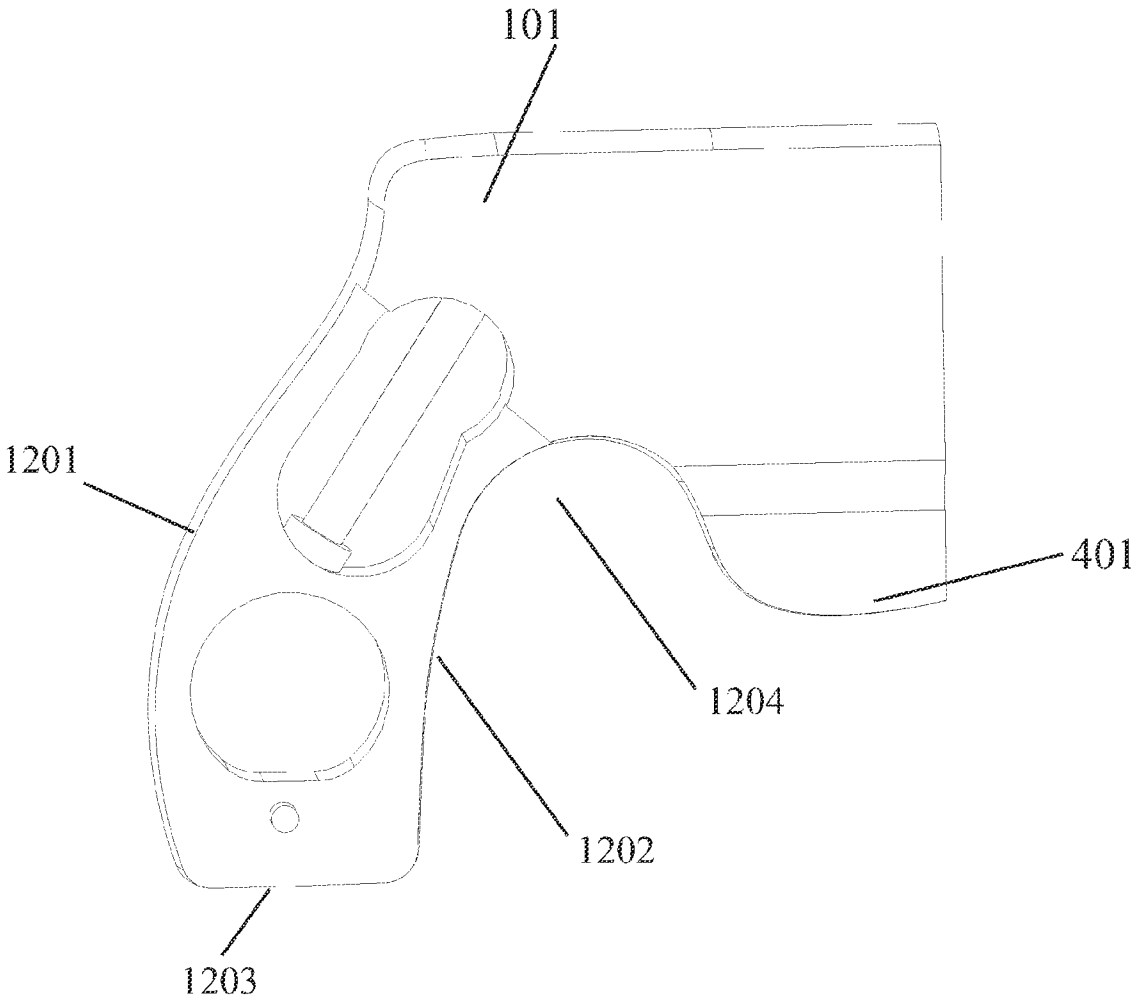
FIG. 12, which shows prior art, illustrates a right side view of a revolver frame form.
Figure 13:
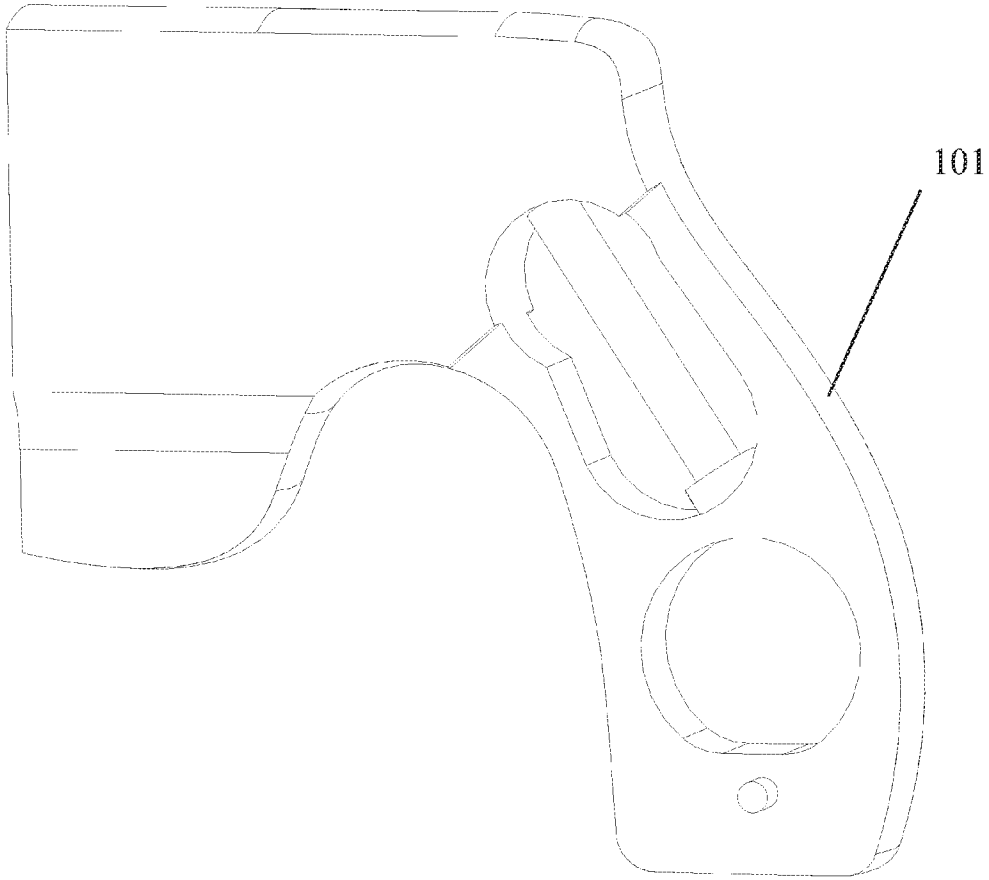
FIG. 13, which shows prior art, illustrates a left side view of a revolver frame form.
Figure 14:
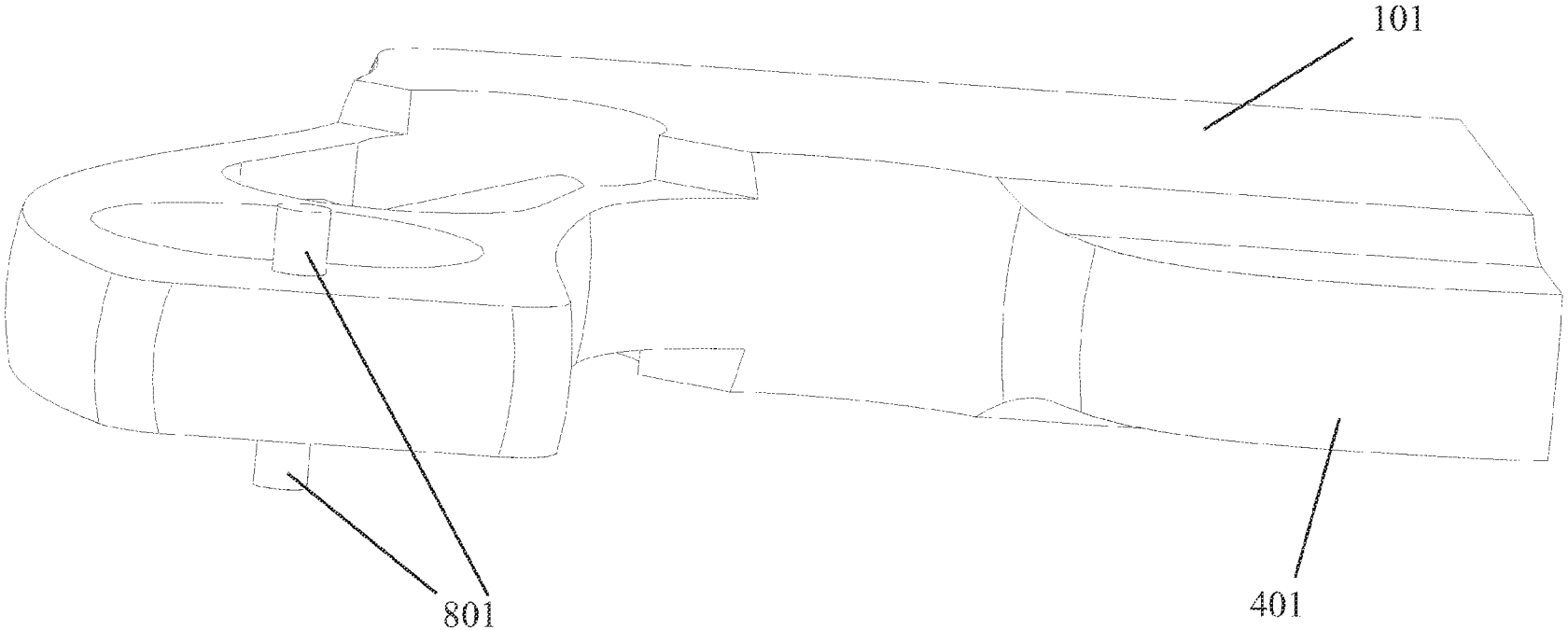
FIG. 14, which shows prior art, illustrates a bottom view of a revolver frame form.
Figure 15:
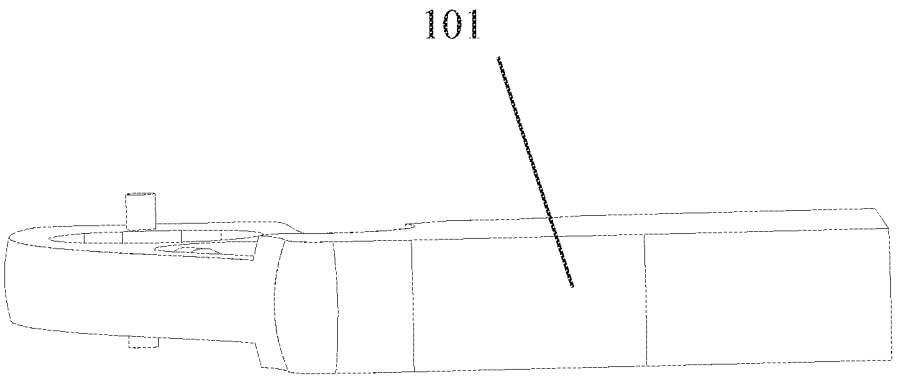
FIG. 15, which shows prior art, lustrates a top view of a revolver frame form.
Figure 16:
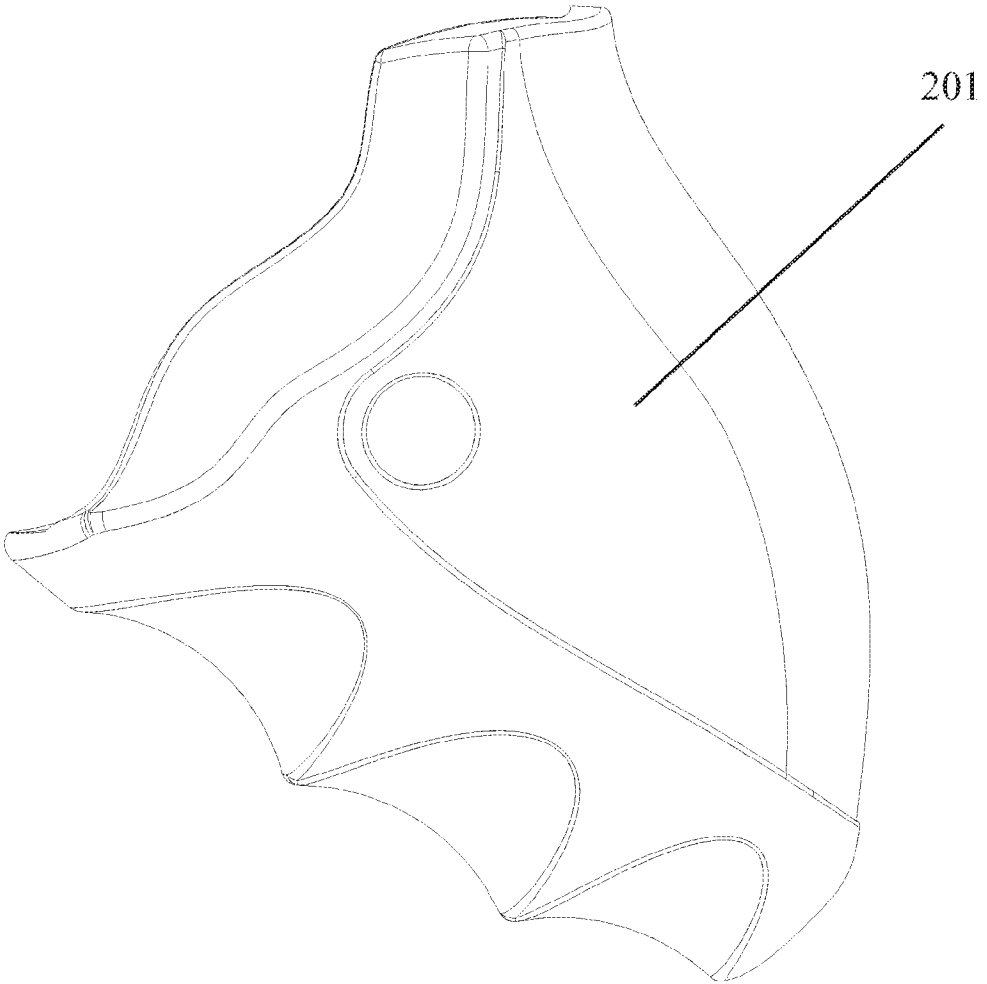
FIG. 16 illustrates a left side view of a left overmold for a cone grip in accordance with aspects of the embodiments.

FIG. 12, which shows prior art, illustrates a right side view of a revolver frame form 101. The silhouette of the frame form 101 provides an indication of the normal grip profile. While using a typical prior art firearm grip, an operator's palm rests against the palm strap 1201 and the fingers wrap around the grip encompass the typical finger interface 1202. The palm strap 1201 and the typical finger interface 1202 do not curve smoothly to meet each other, but instead meet the essentially flat base 1203 at the bottom. In addition, the large gap 1204 between the typical finger interface 1202 and the trigger guard 401 is readily apparent. The cone grip 102 occupies the large gap 1204 to provide a finger interface 301 that begins much further forward than otherwise possible.

Also with respect to FIG. 12, the revolver frame 101 represented by the frame form 101 clearly shows the large gap 1204 between the finger interface 301 and the trigger guard 401. Many semi-automatic handguns also exhibit a similar large gap. As such, a modification of the illustrated cone grip design would be appropriate for semi-automatic handguns to thereby move the forward edge 402 of the finger interface 301 forward and to fill the large gap 1204. The operator of a semi-automatic handgun would thereby enjoy the ergonomic benefits of the cone grip design.

FIGS. 16-25 illustrate views of a left overmold 201 for a cone grip 102 in accordance with aspects of the embodiments.

Figure 17:
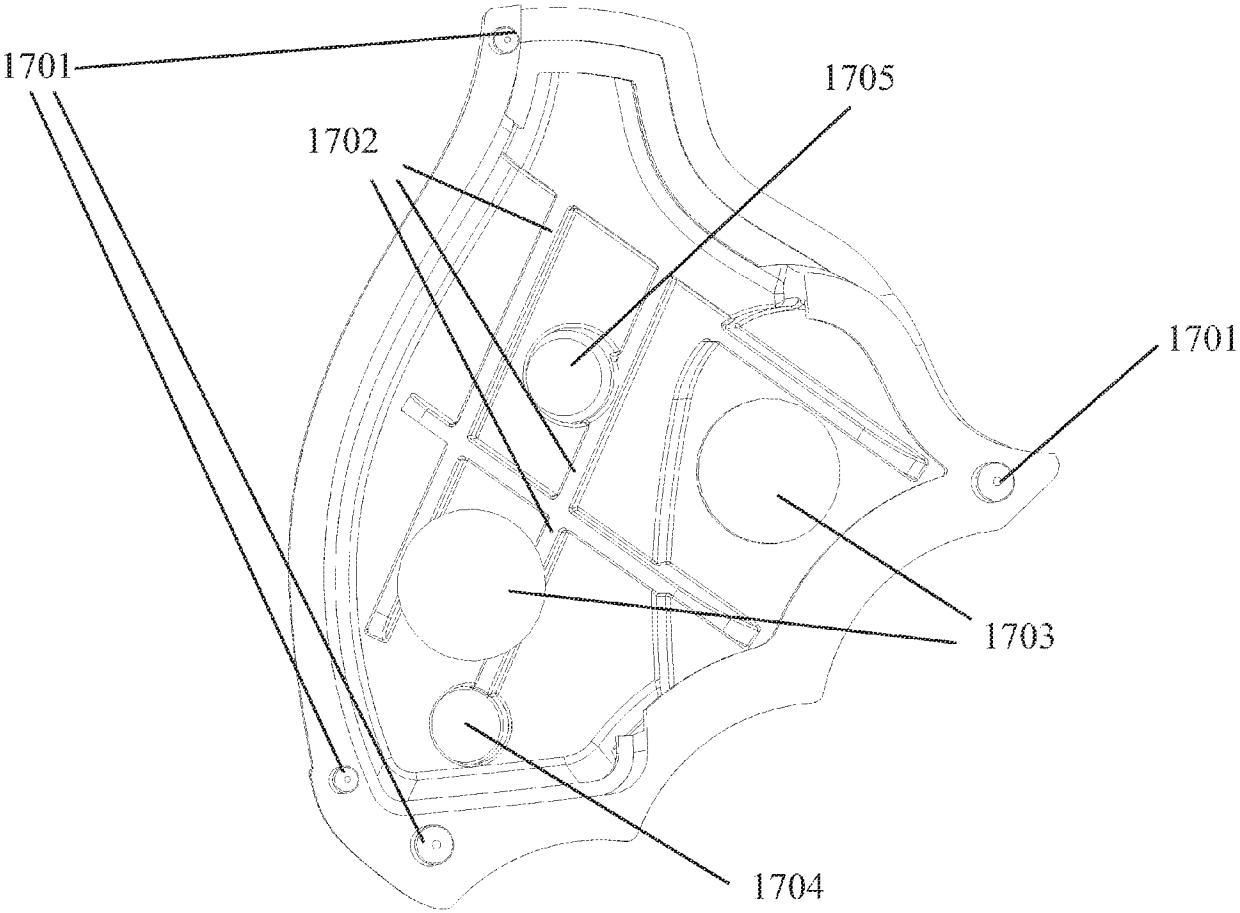
FIG. 17 illustrates a right side view of a left overmold for a cone grip in accordance with aspects of the embodiments.
Figure 18:
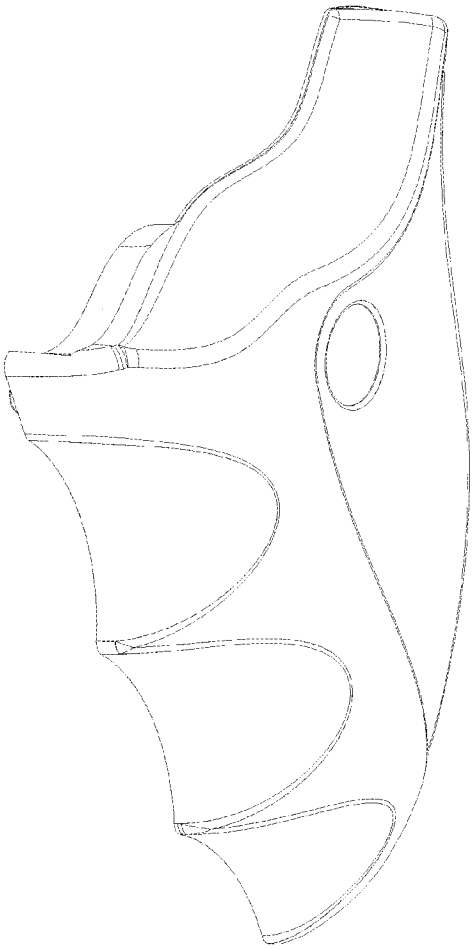
FIG. 18 illustrates a front left view of a left overmold for a cone grip in accordance with aspects of the embodiments.
Figure 19:
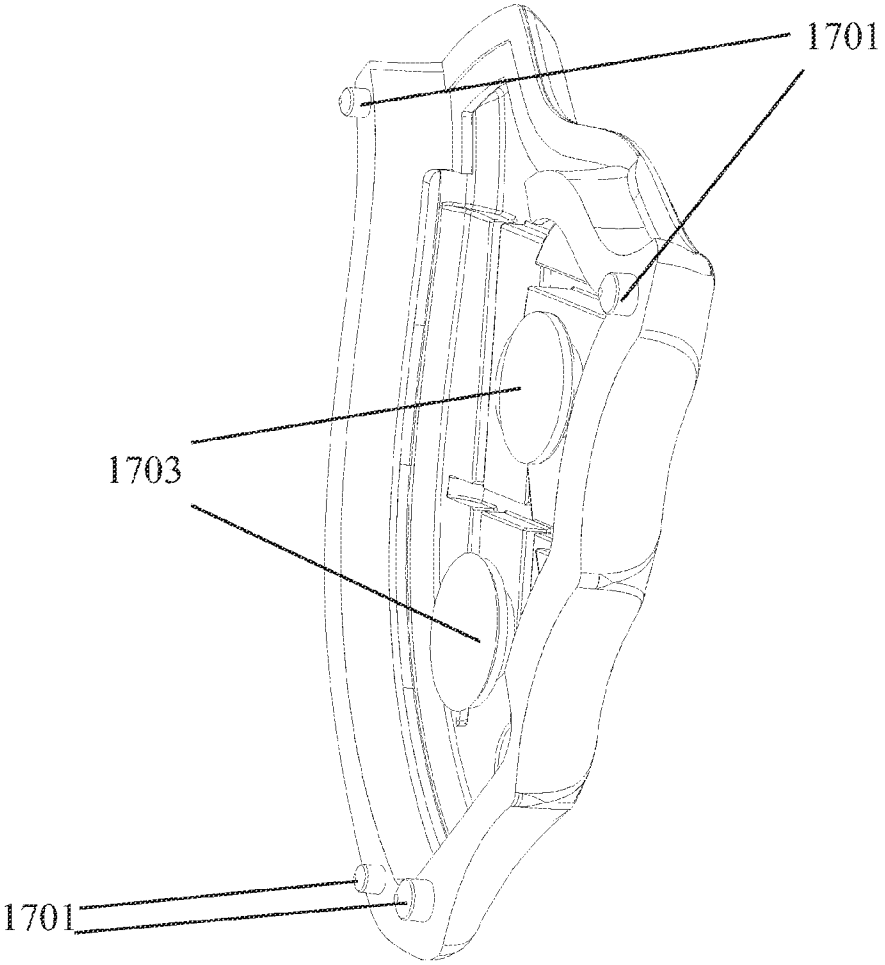
FIG. 19 illustrates a right front view of a left overmold for a cone grip in accordance with aspects of the embodiments.
Figure 20:
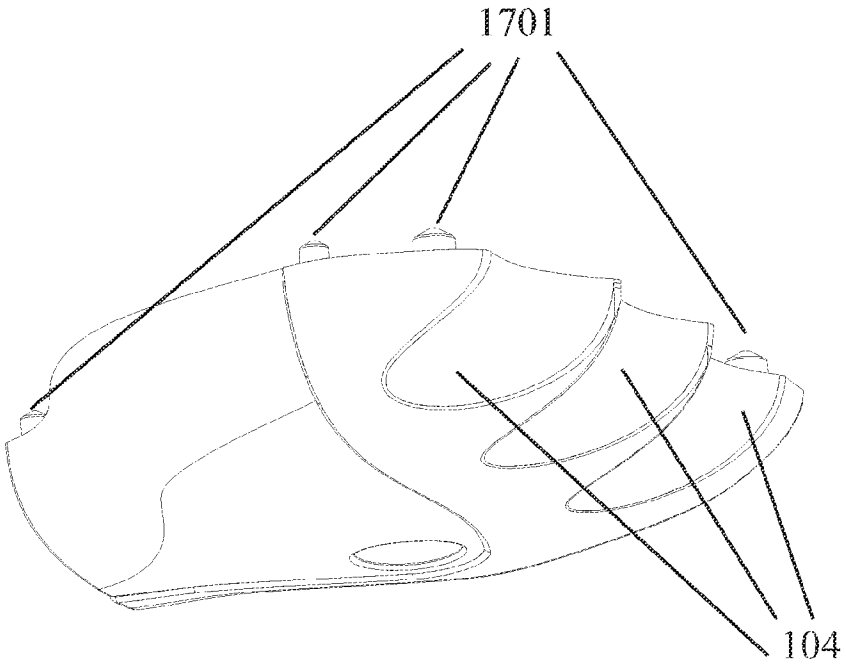
FIG. 20 illustrates a bottom left view left overmold for a cone grip in accordance with aspects of the embodiments.
Figure 21:
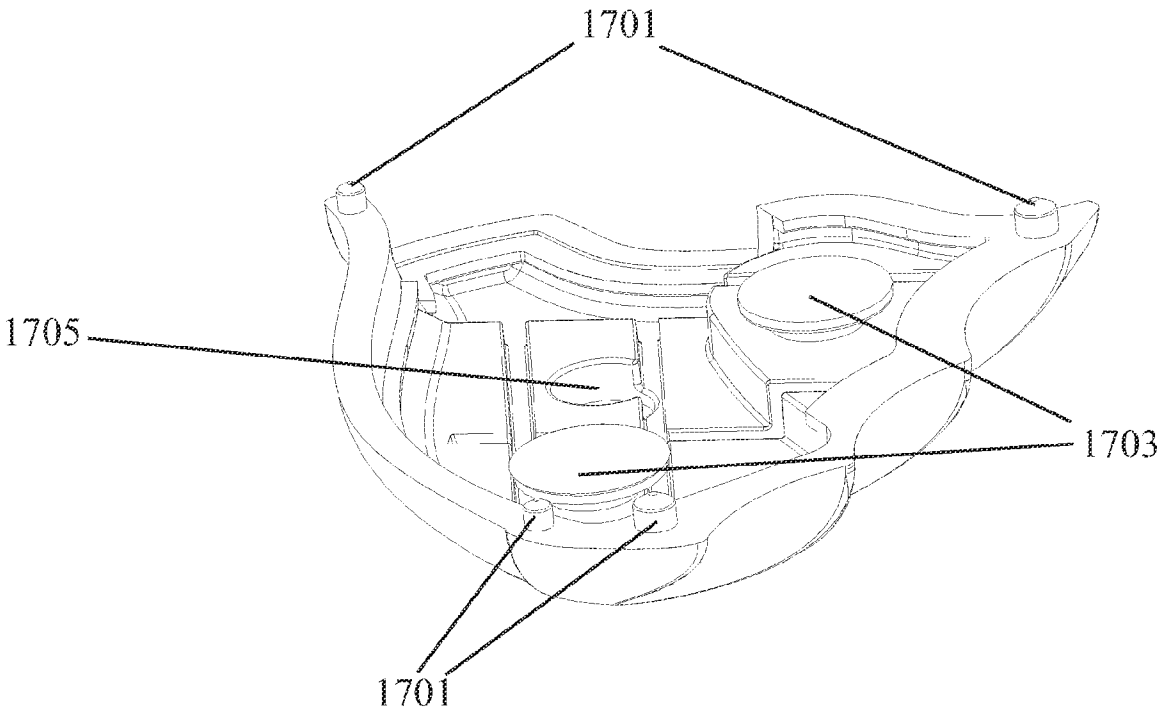
FIG. 21 illustrates a bottom right view of a left overmold for a cone grip in accordance with aspects of the embodiments.
Figure 22:
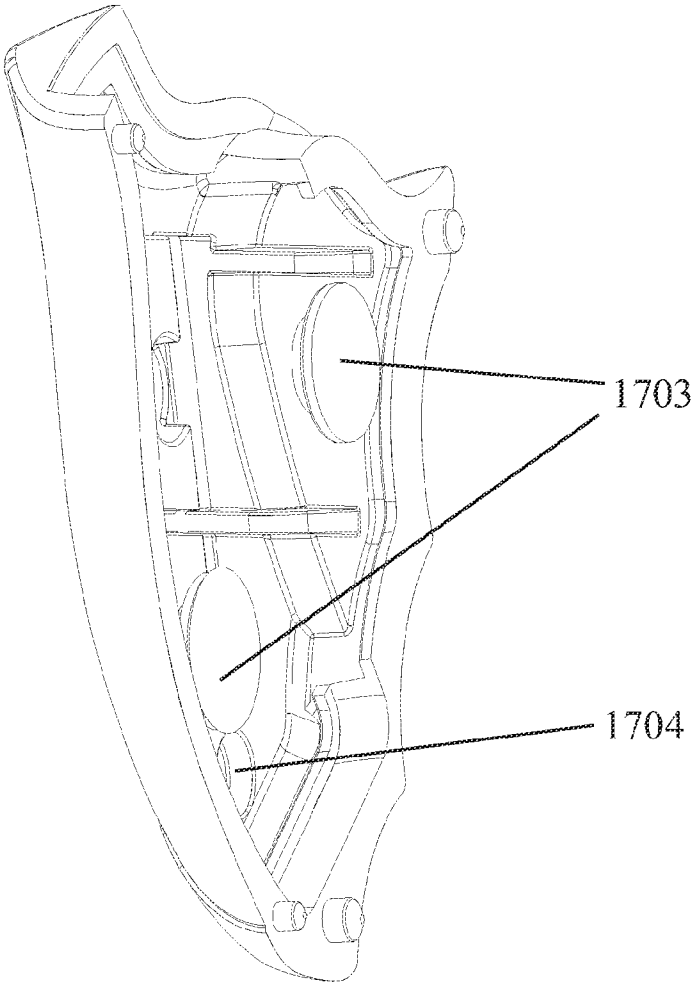
FIG. 22 illustrates a back right view of a left overmold for a cone grip in accordance with aspects of the embodiments.
Figure 23:
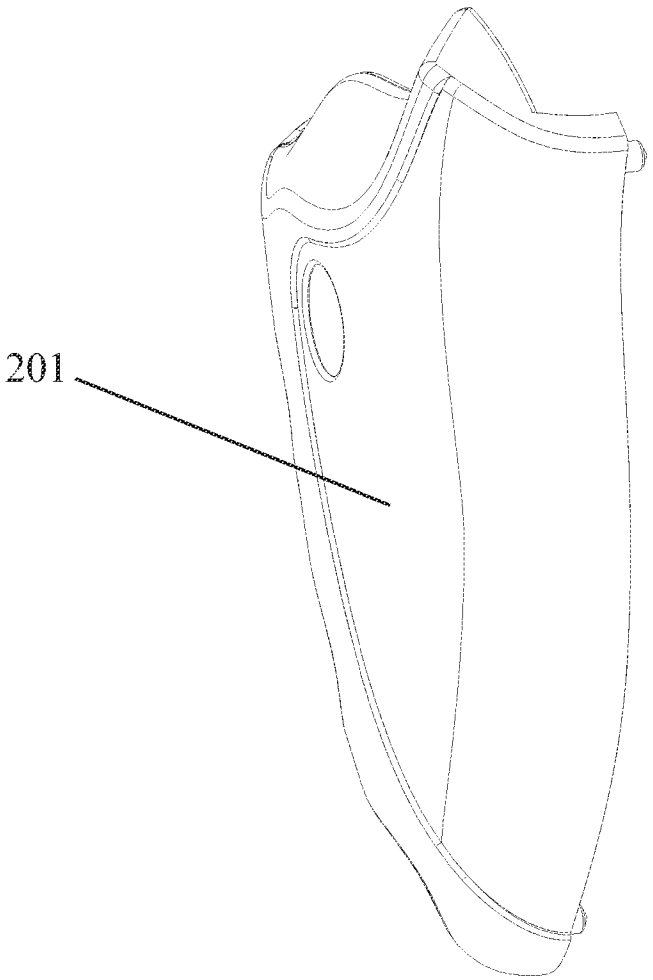
FIG. 23 illustrates a back left view of a left overmold for a cone grip in accordance with aspects of the embodiments.
Figure 24:
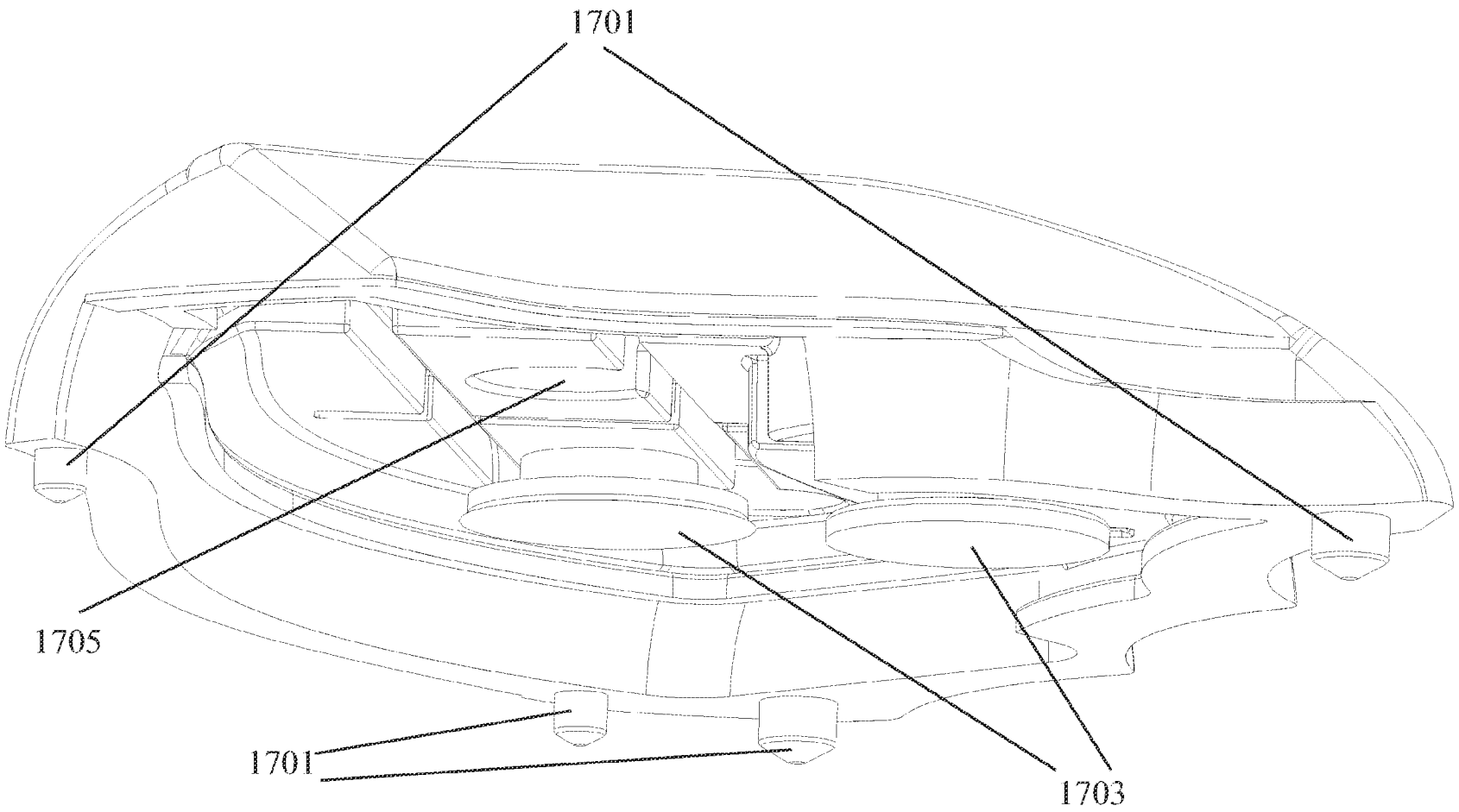
FIG. 24 illustrates a top right view of a left overmold for a cone grip in accordance with aspects of the embodiments.
Figure 25:
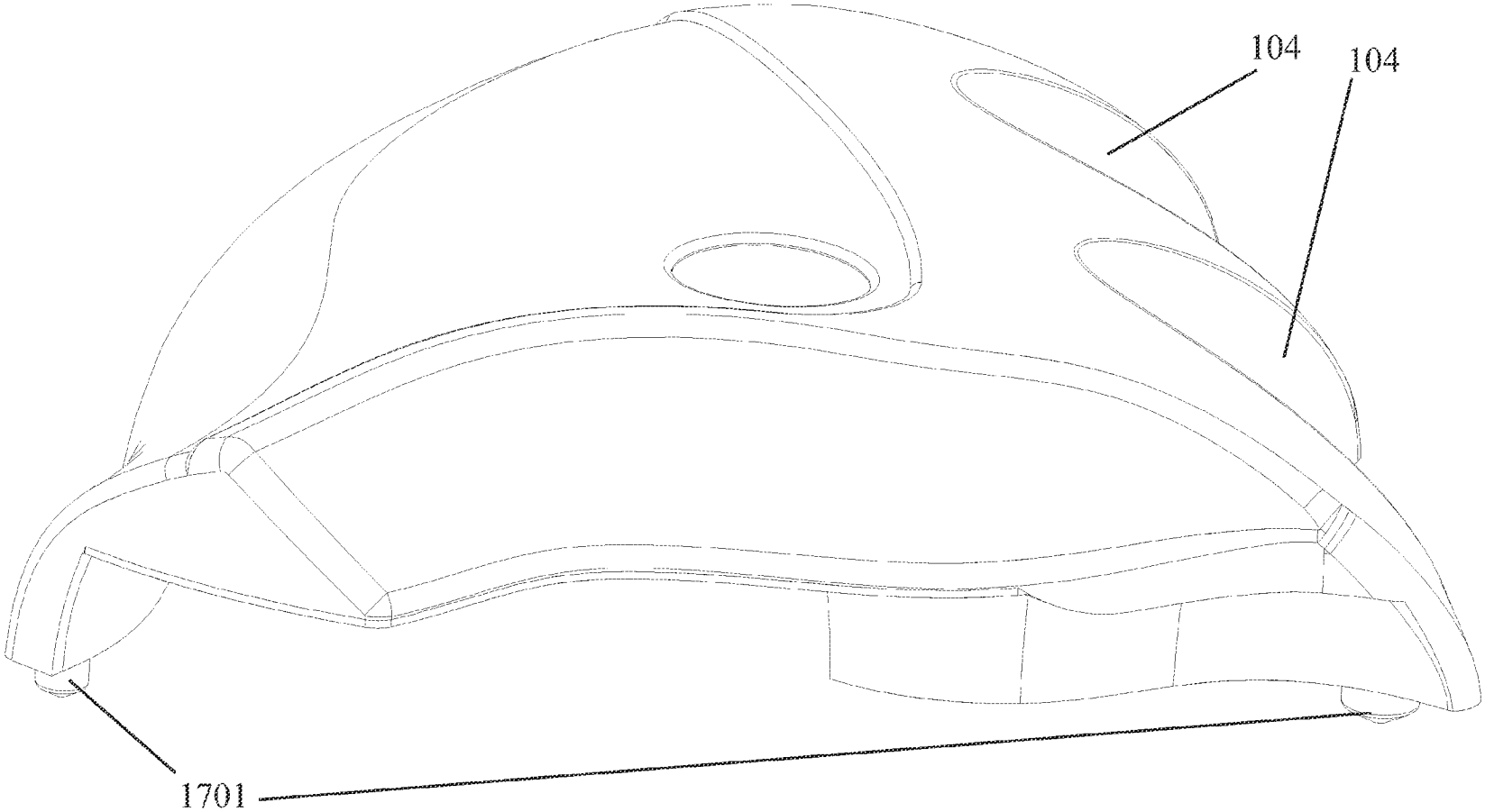
FIG. 25 illustrates a top left view of a left overmold for a cone grip in accordance with aspects of the embodiments.

FIG. 17 illustrates a right side view of a left overmold 201 for a cone grip 102 in accordance with aspects of the embodiments. The left overmold 201, as with the right overmold 103, is typically thermoformed or thereto-set to provide a firm but not hard or stiff gripping surface. More specifically, the durometer of the left and right overmolds 103, 201 can have Shore Hardness A 55 or thereabout. In general, Shore Hardness A 55 works very well with the cone grip 102 although values between 40 and 65 have produced good grip. Manufacturing process has repeatably produced durometers within plus or minus 2% of the desired value.

The illustrated overmold embodiments can be produced by an over-molding process with a substrate placed in a mold, the mold sealed, and then the overmold material introduced into the mold. Given an overmold material that melts at 375 degrees, the substrate must not melt at 375 degrees.

The left side overmold 201 has pins 1701 that interface with pin holes 4601 in the right side overmold 103. Certain of the structures are the result of material flowing into and around the left substrate 501. Those structures include the formed plugs 1703, the formed indent 1704, the insert hole 1705, and the rib grooves 1702, Notice that the formed plugs 1703 are shaped like disks atop cylinders. The formed plugs 1703 get their shape from the overmold material flowing through a hole and filling a cavity on the other side of the hole. The insert hole 1705 is often a blind hole.

FIGS. 26-35 illustrate views of a left substrate 501 for a cone grip 102 in accordance with aspects of the embodiments.

Figure 26:
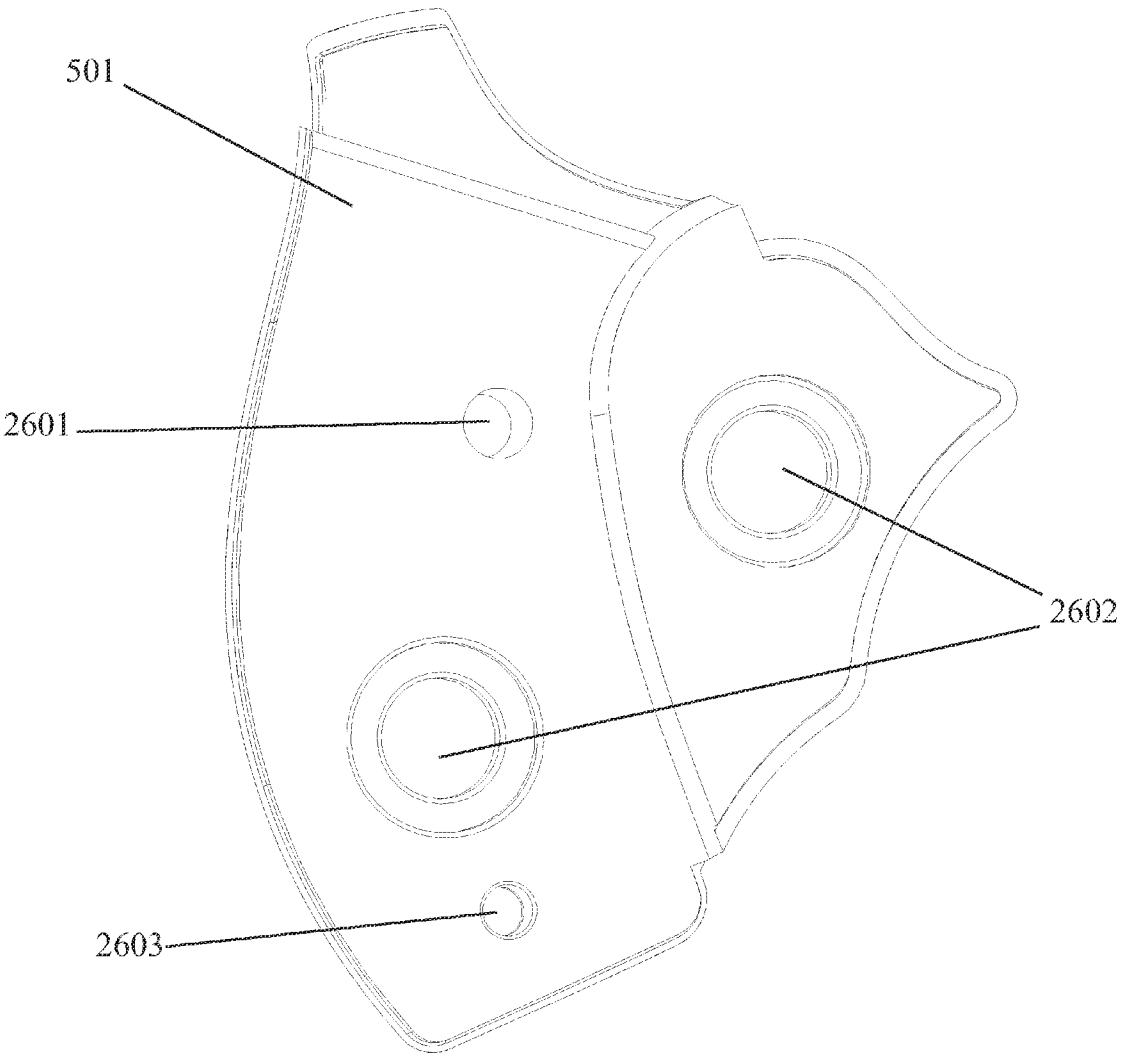
FIG. 26 illustrates a right side view of a left substrate for a cone grip in accordance with aspects of the embodiments.

FIG. 26 illustrates a right side view of a left substrate 501 for a cone grip 102 in accordance with aspects of the embodiments. The overmold material flowing into the plug forms 2602 produces the formed plugs 1703. The stud hole 2603 matches the frame stud 801 in the revolver frame 101 or frame form 101. The insert holder 2601 is a hole into which the brass insert 503 can be pressed. Note that other embodiments could provide a threaded hole instead of an insert holder 2601. Also note that the substrate can be smaller such that the stud hole 2603 is molded into the overmold material instead of the substrate material.

Figure 27:
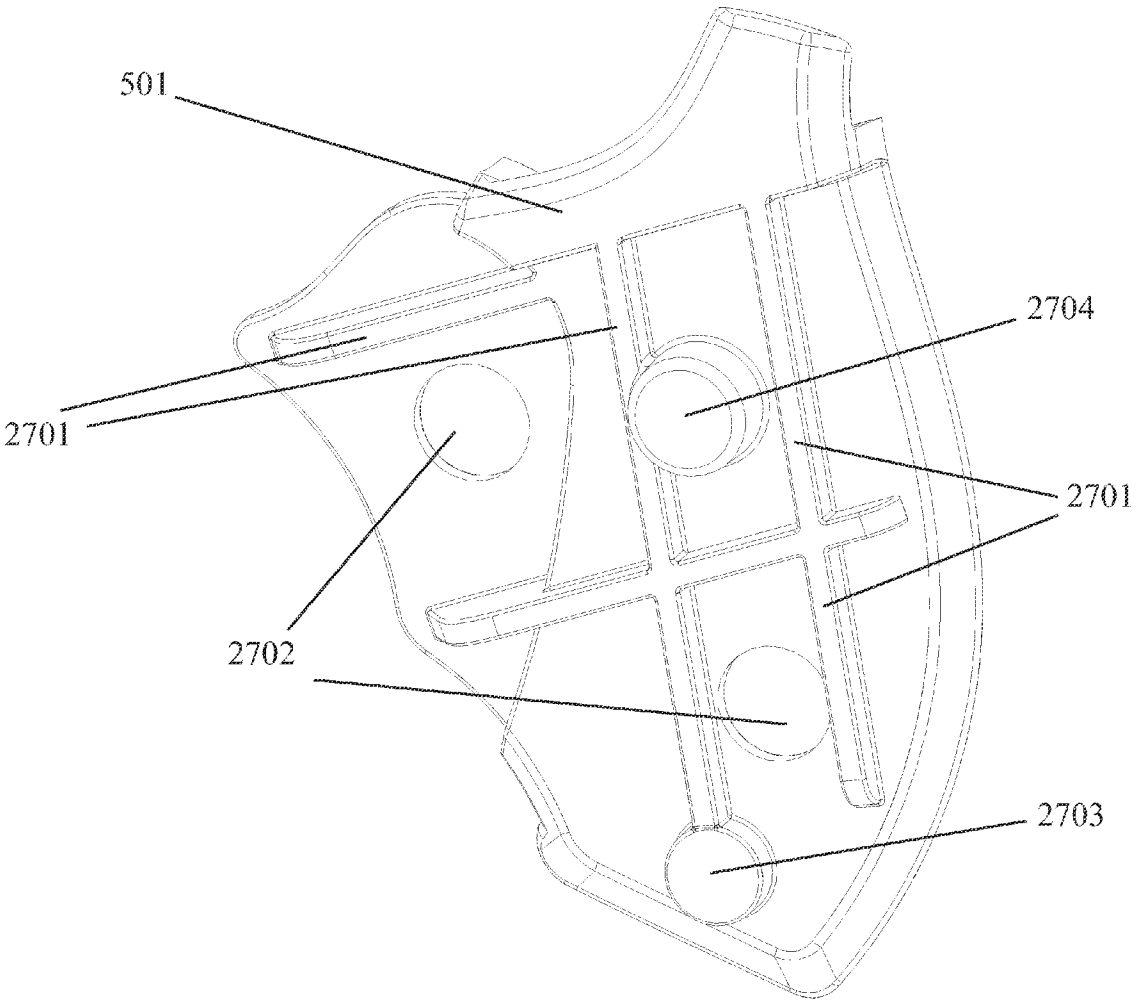
FIG. 27 illustrates a left side view of a left substrate for a cone grip in accordance with aspects of the embodiments.
Figure 28:
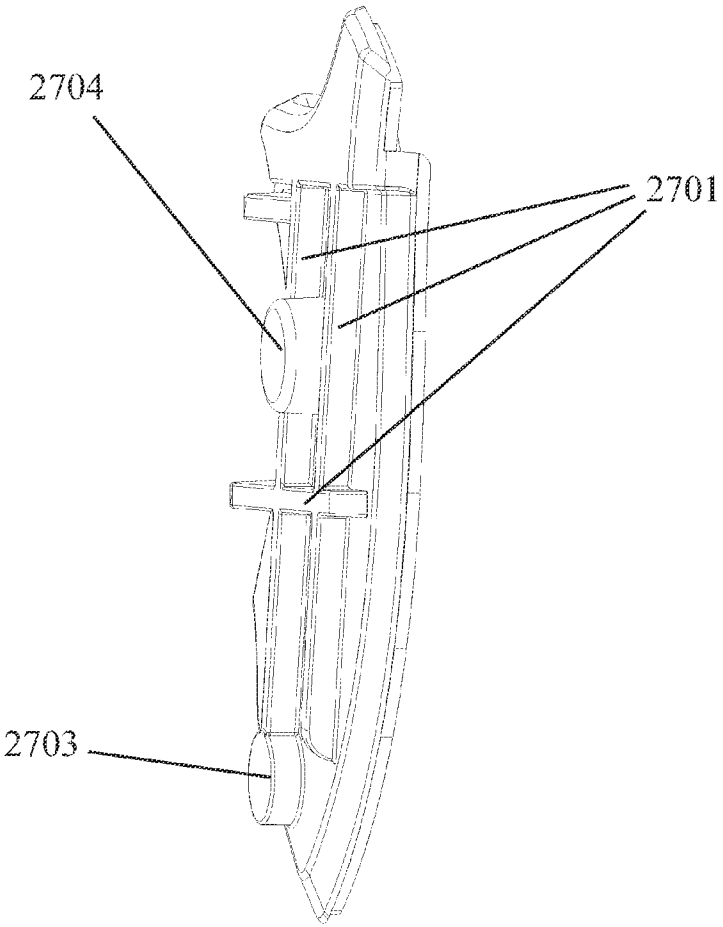
FIG. 28 illustrates a back left view of a left substrate for a cone grip in accordance with aspects of the embodiments.
Figure 29:
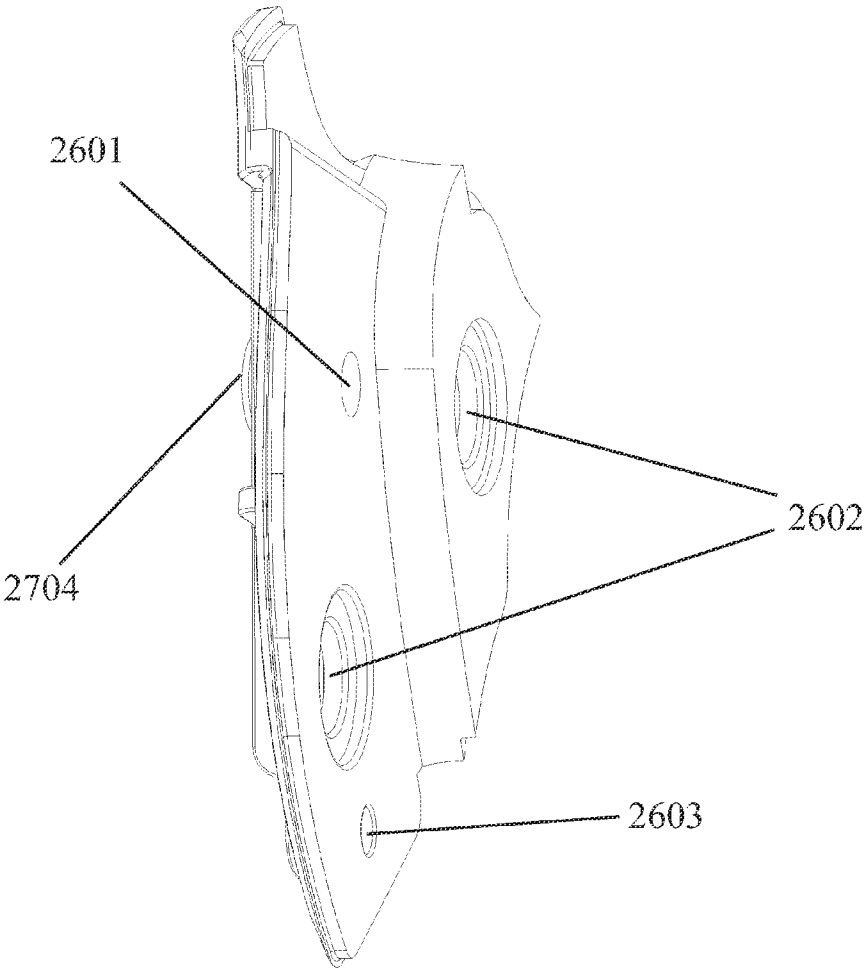
FIG. 29 illustrates a back right view of a left substrate for a cone grip in accordance with aspects of the embodiments.
Figure 30:
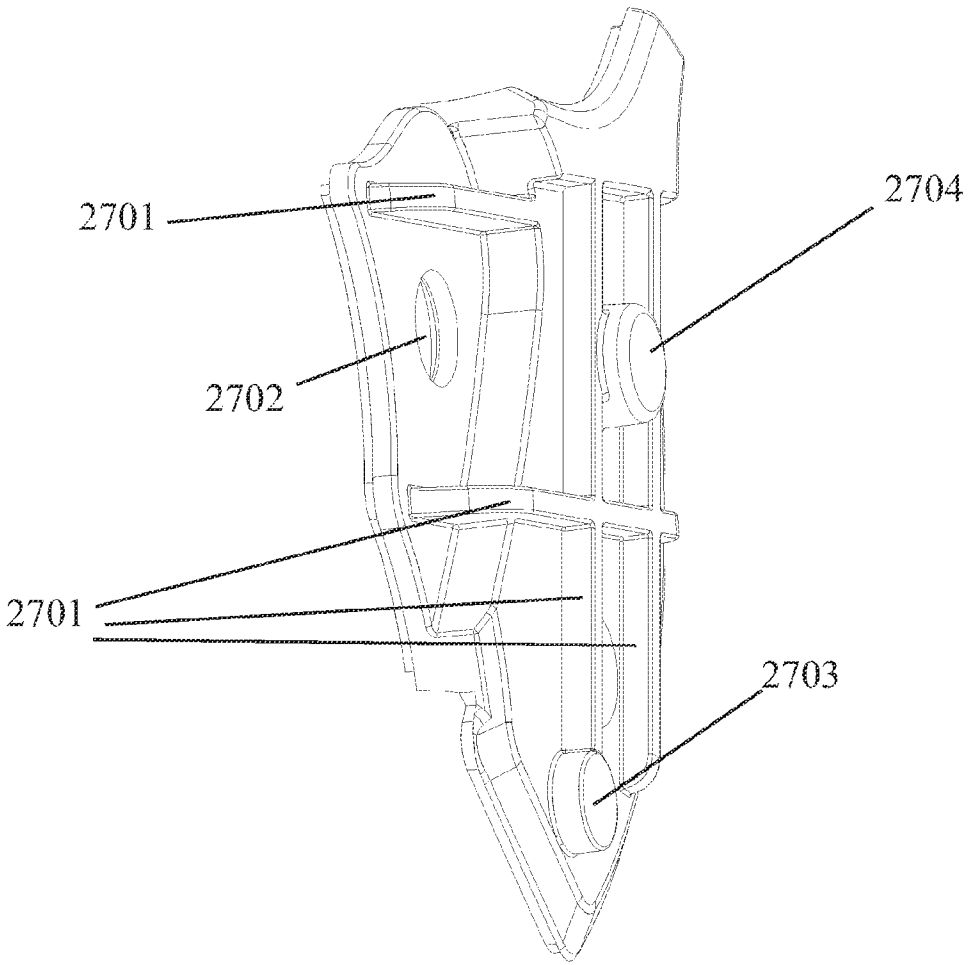
FIG. 30 illustrates a front left view of a left substrate for a cone grip in accordance with aspects of the embodiments.
Figure 31:
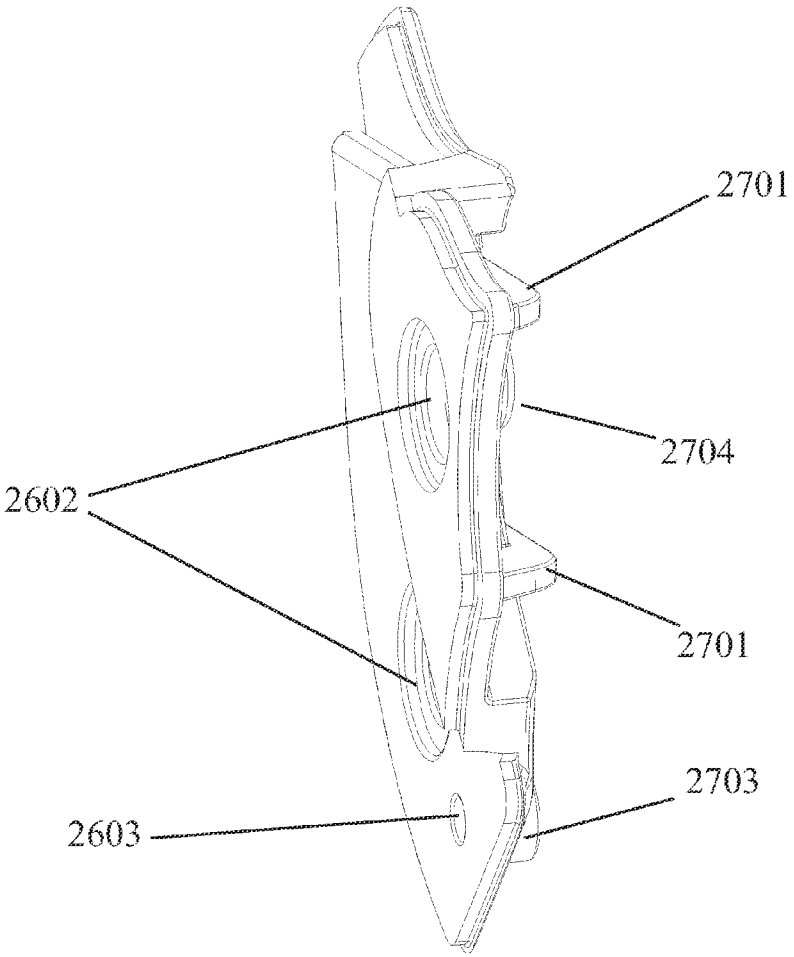
FIG. 31 illustrates a right front view of a left substrate for a cone grip in accordance with aspects of the embodiments.
Figure 32:
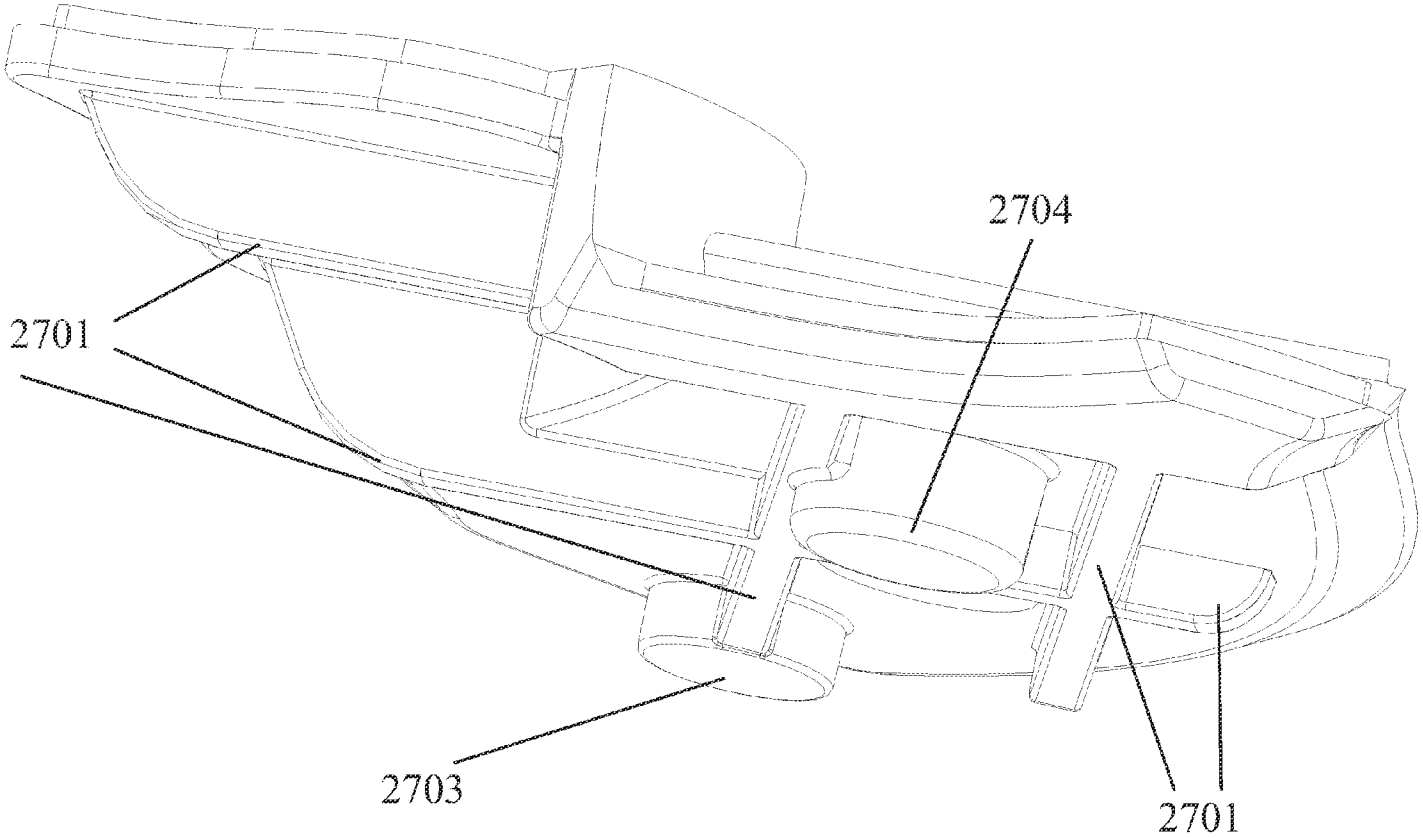
FIG. 32 illustrates a top left view of a left substrate for a cone grip in accordance with aspects of the embodiments.
Figure 33:
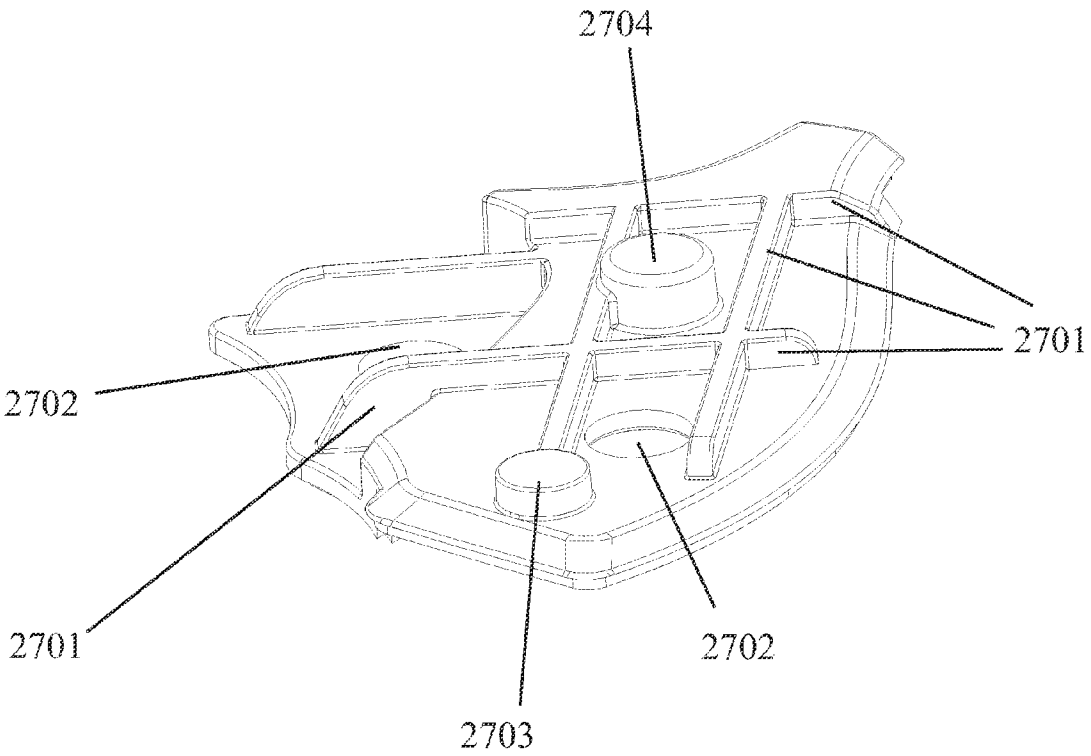
FIG. 33 illustrates a bottom left view of a left e for a cone grip in accordance with aspects of the embodiments.
Figure 34:
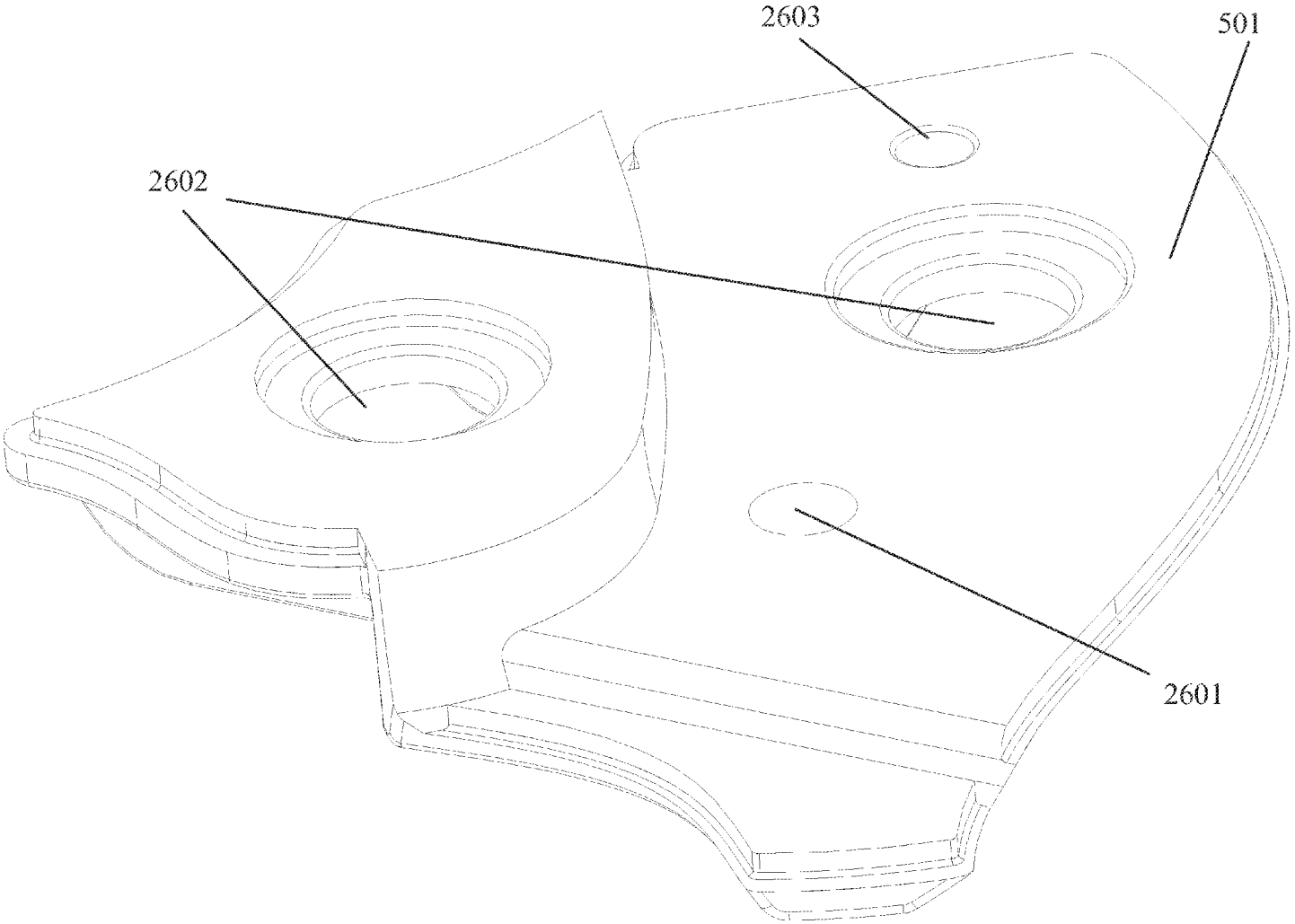
FIG. 34 illustrates a top right view of a left substrate for a cone grip in accordance with aspects of the embodiments.
Figure 35:
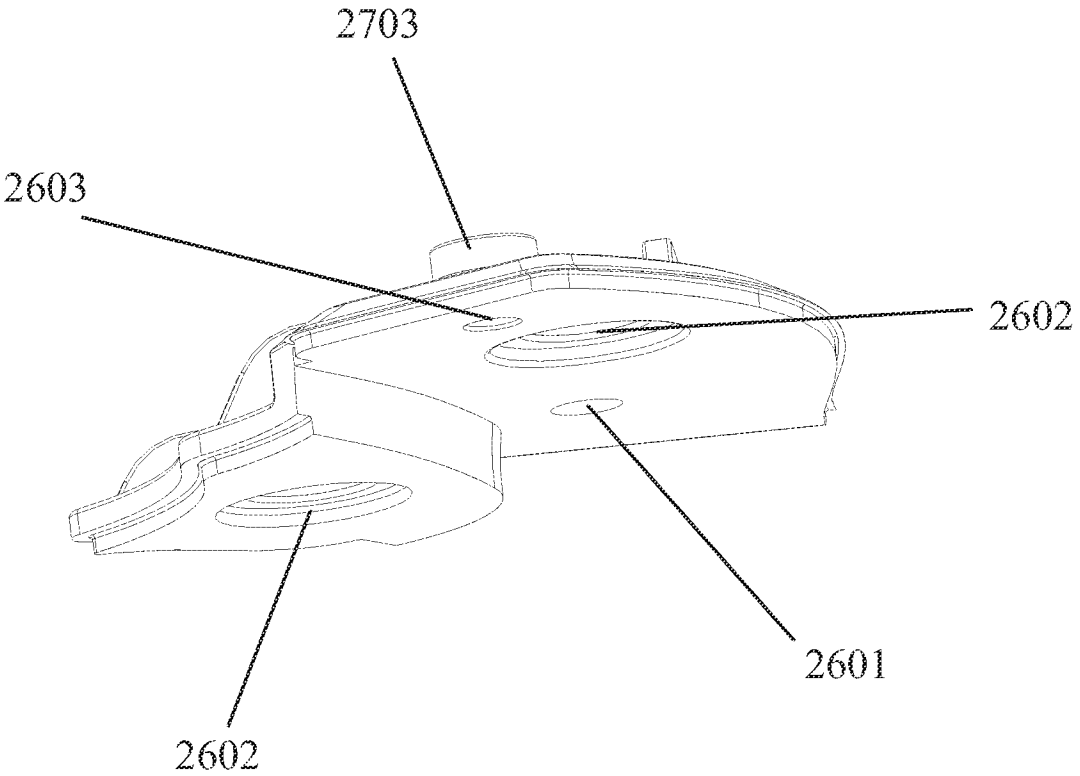
FIG. 35 illustrates a bottom right view of a left substrate for a cone grip in accordance with aspects of the embodiments.

FIG. 27 illustrates a left side view of a left substrate 501 for a cone grip 102 in accordance with aspects of the embodiments. The overmold material flows through the plug holes 2702 to thereby produce the formed plugs 1703. The overmold material flows around the insert hole form 2704, indent form 2703, and ribbing 2701 to thereby produce the insert hole 1705, formed indent 1704, and plug hole grooves 1702, respectively.

FIGS. 36-45 illustrate views of a right substrate 502 for a cone grip 102 in accordance with aspects of the embodiments.

Figure 36:
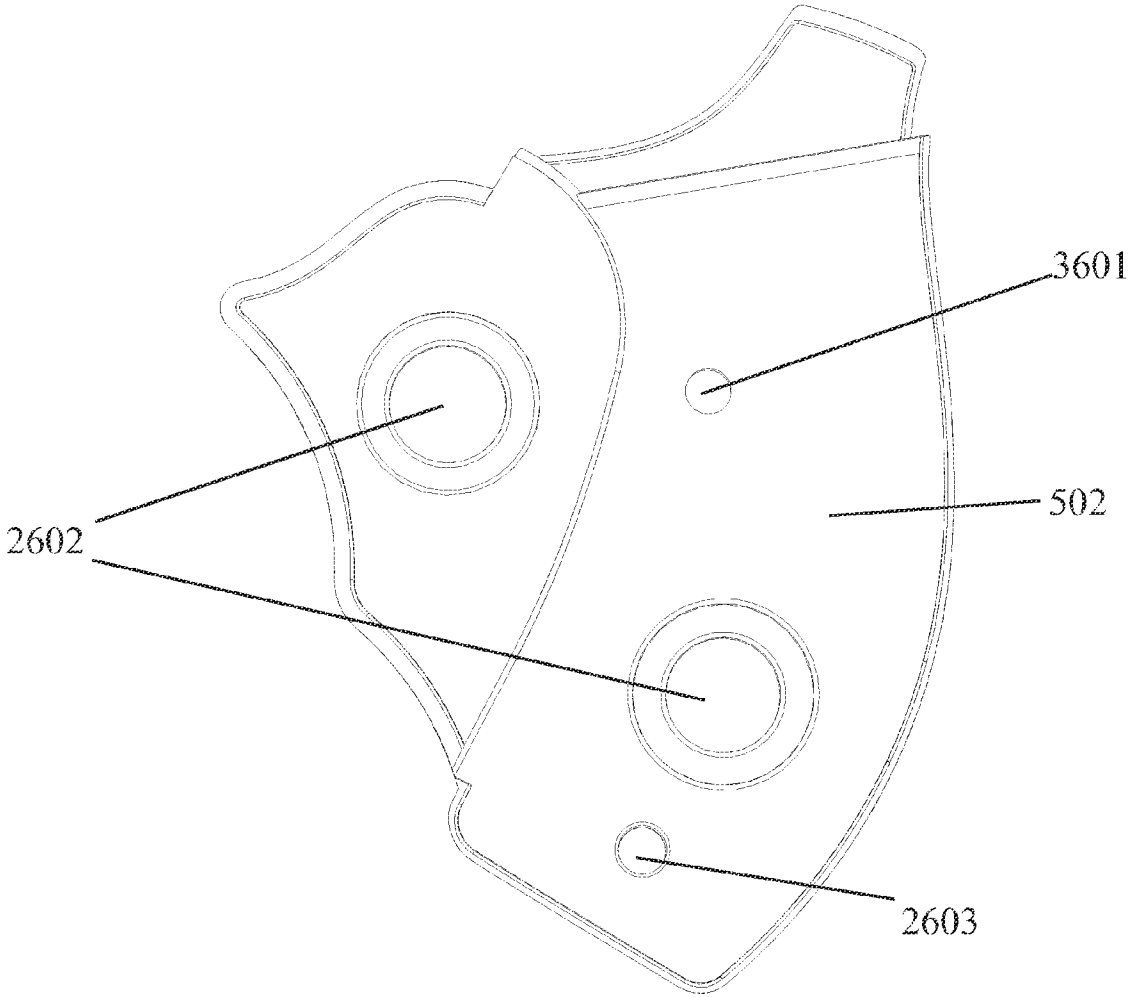
FIG. 36 illustrates a left side view of a right substrate for a cone grip in accordance with aspects of the embodiments.

FIG. 36 illustrates a left side view of a right substrate 502 for a cone grip 102 in accordance with aspects of the embodiments. The right substrate 502 is very similar to the left substrate 501 with the exception of providing a screw hole 3601 for the machine screw. Otherwise, similar structures perform similar functions.

Figure 37:
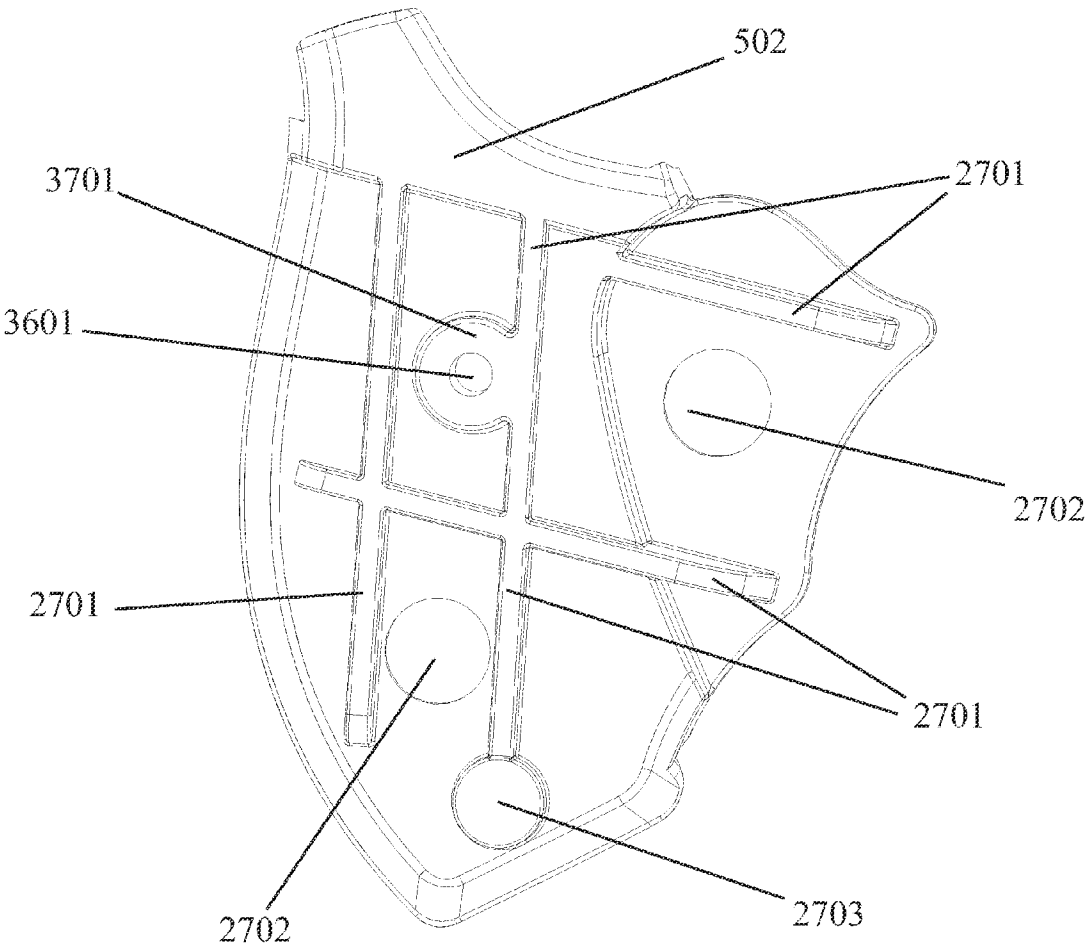
FIG. 37 illustrates a right side view of a right substrate for a cone grip in accordance with aspects of the embodiments.
Figure 38:
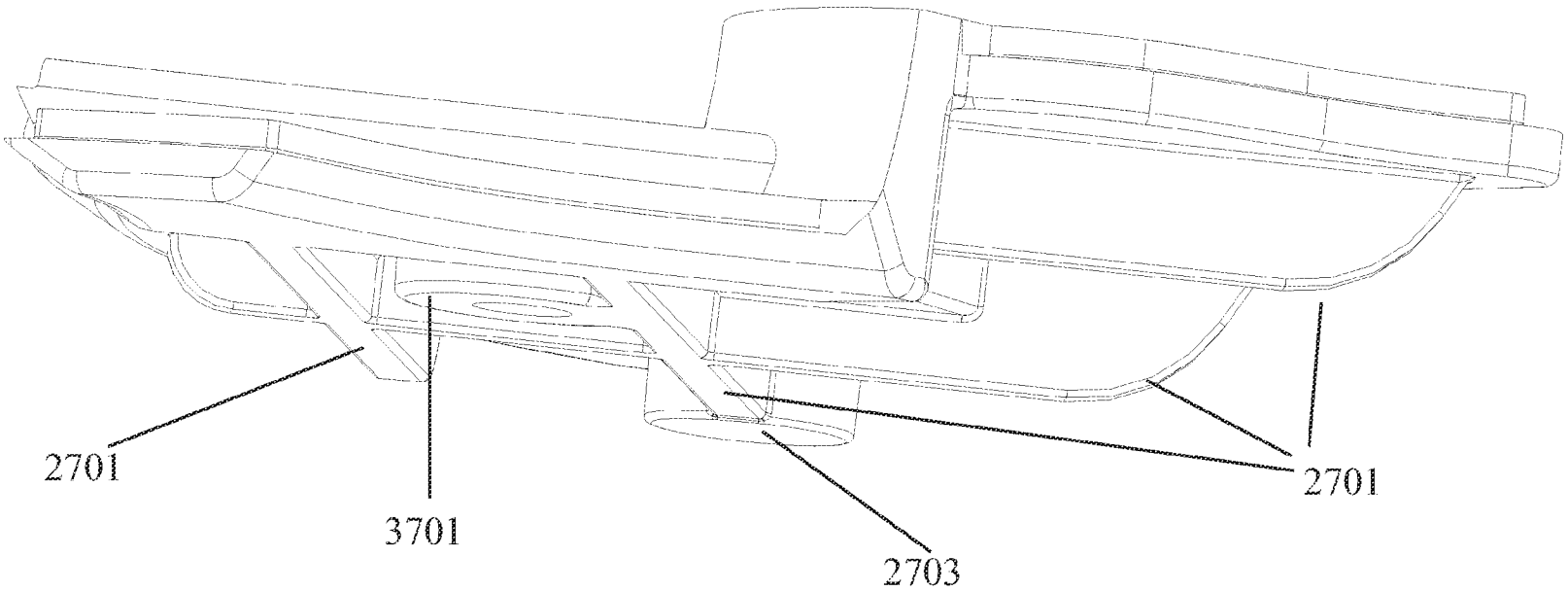
FIG. 38 illustrates a top right view of a right substrate or a cone grip in accordance with aspects of the embodiments.
Figure 39:
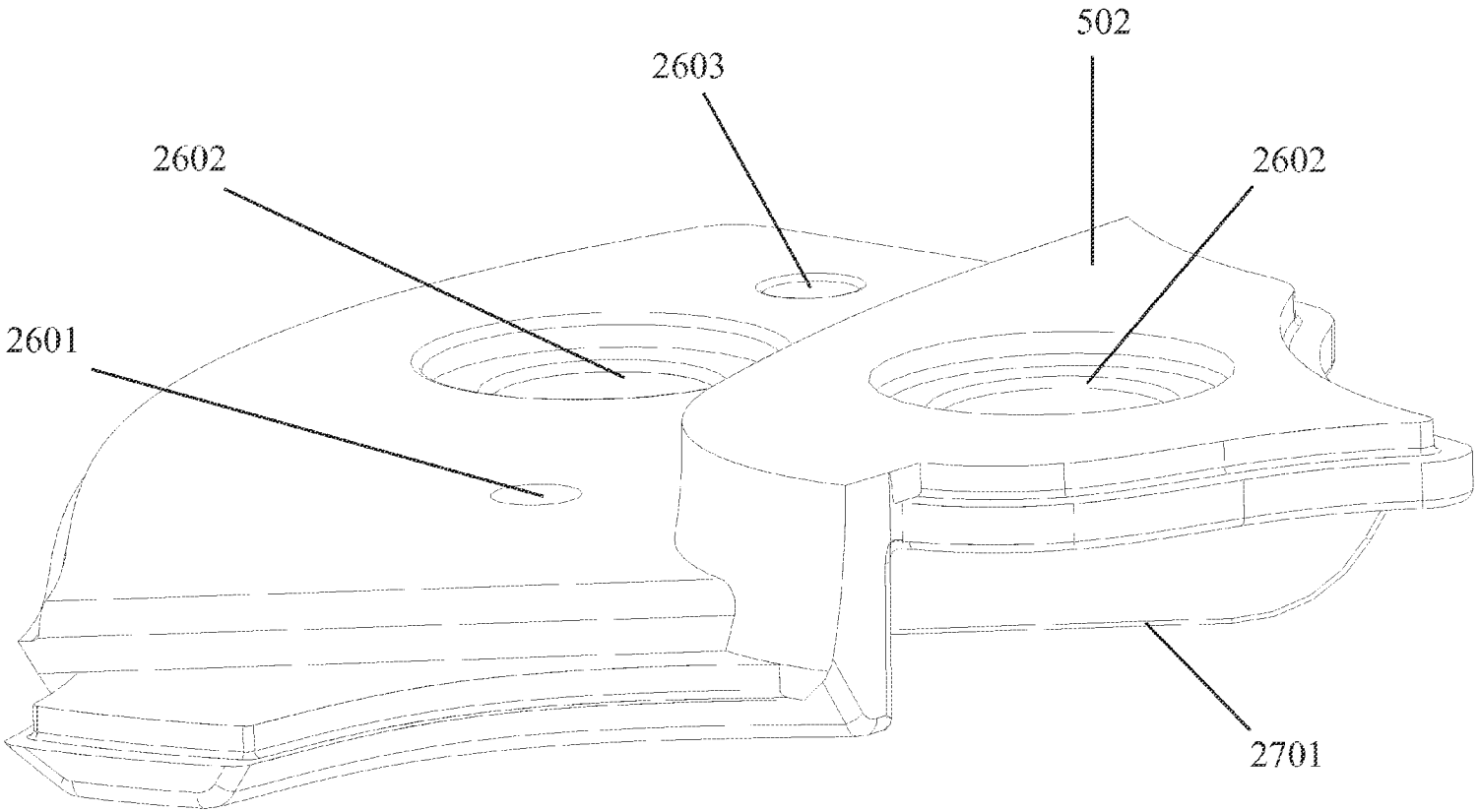
FIG. 39 illustrates a top left view of a right substrate for a cone grip in accordance with aspects of the embodiments.
Figure 40:
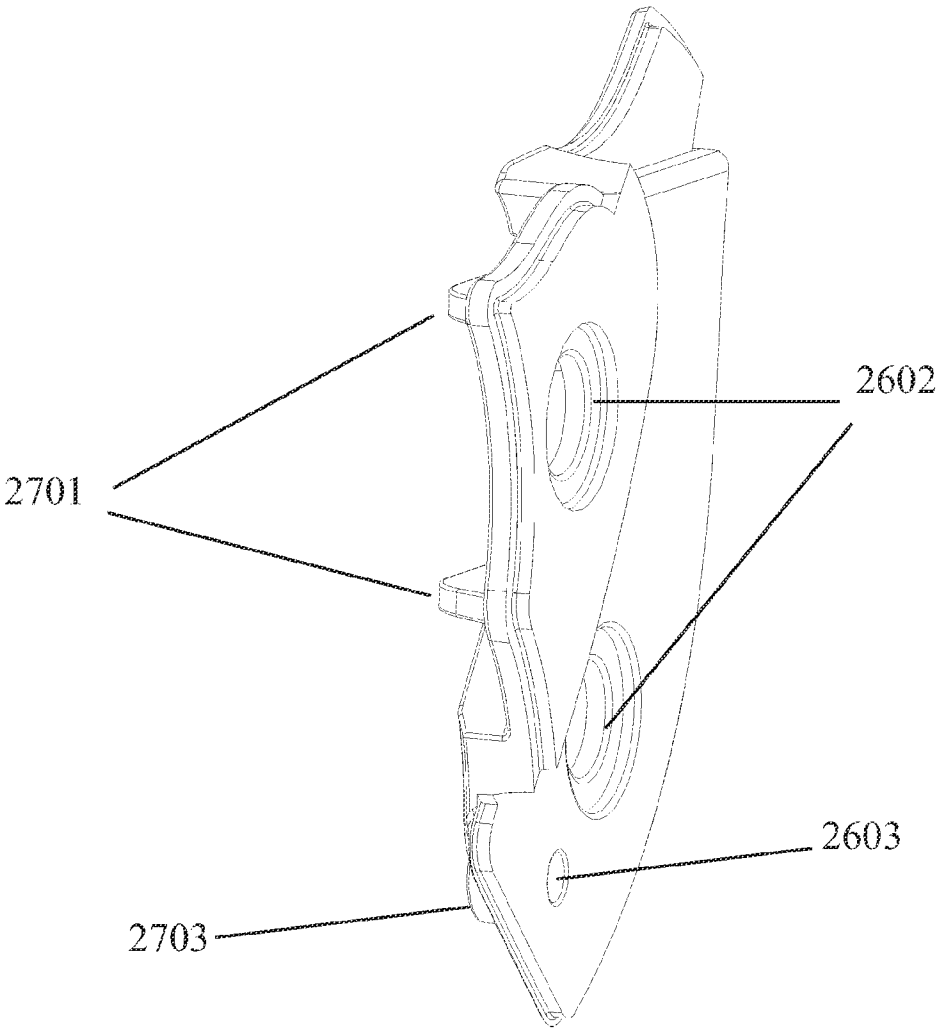
FIG. 40 illustrates a front left view of a right substrate for a cone grip in accordance with aspects of the embodiments.
Figure 41:
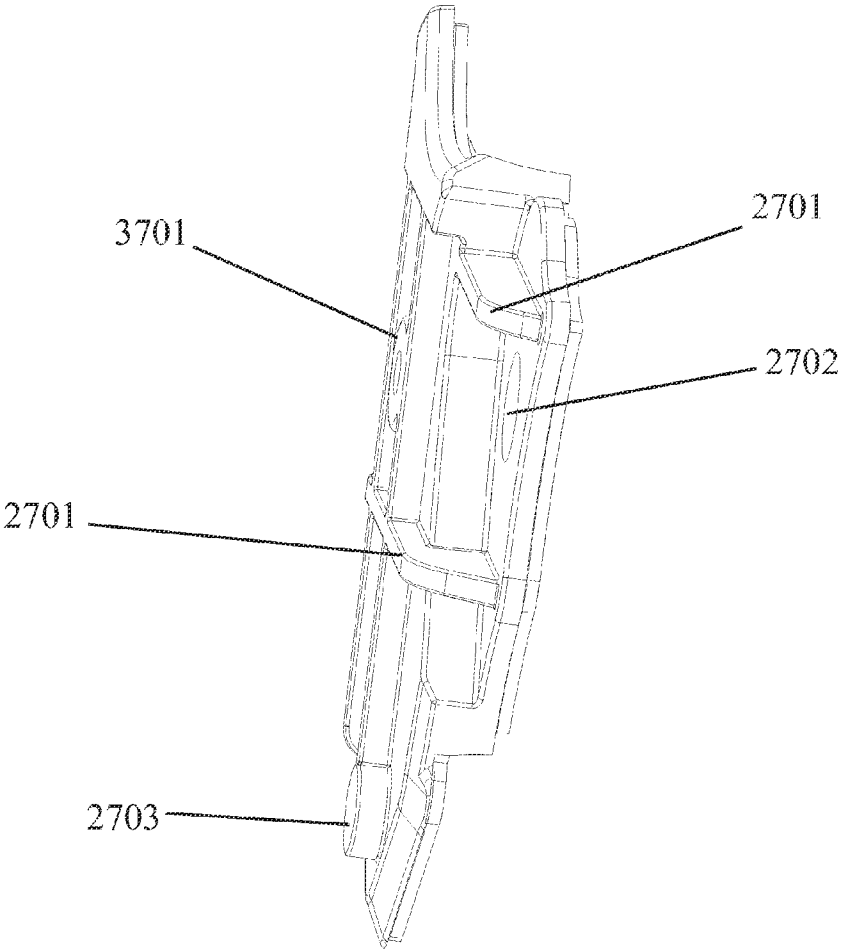
FIG. 41 illustrates a front right view of a right substrate for a cone grip in accordance with aspects of the embodiments.
Figure 42:
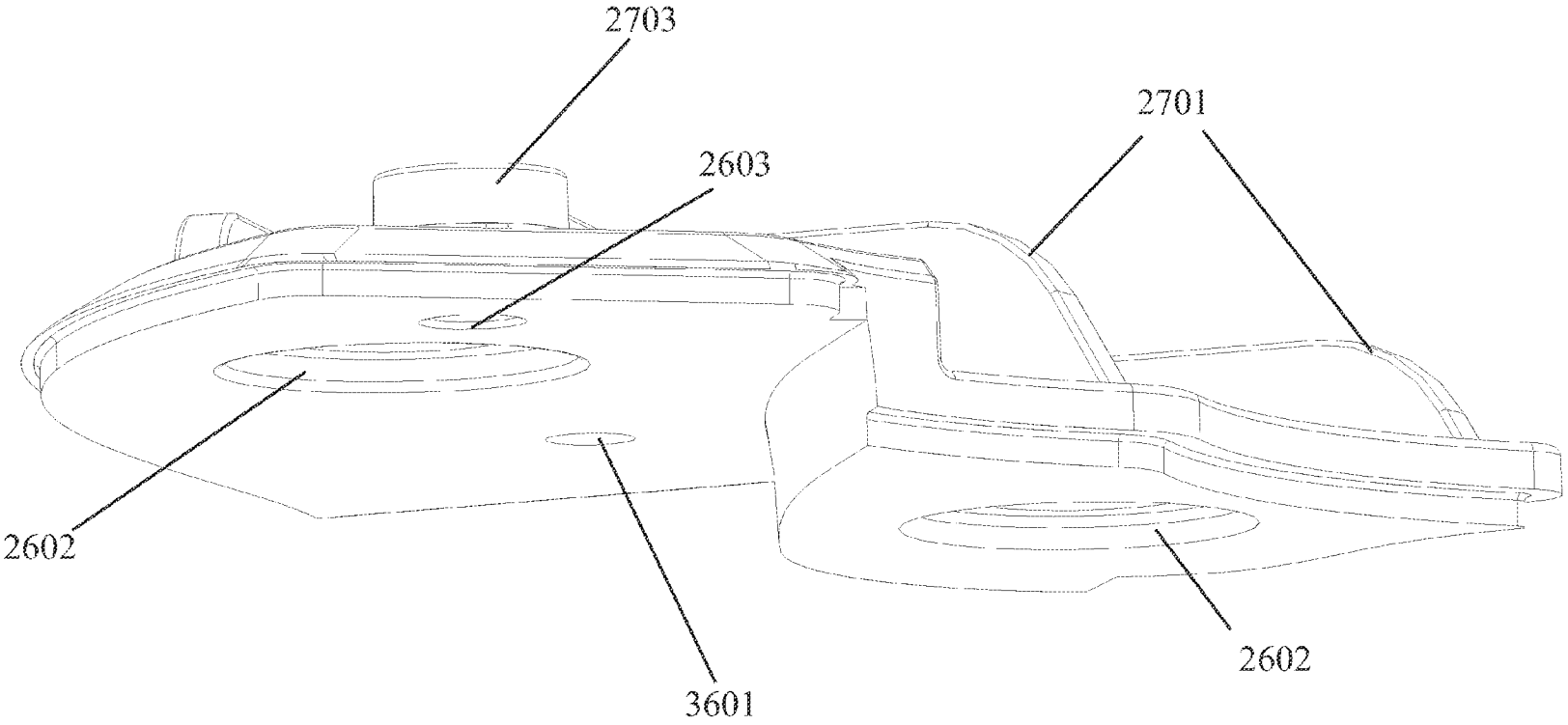
FIG. 42 illustrates a bottom left view of a right substrate for a cone grip in accordance with aspects of the embodiments.
Figure 43:
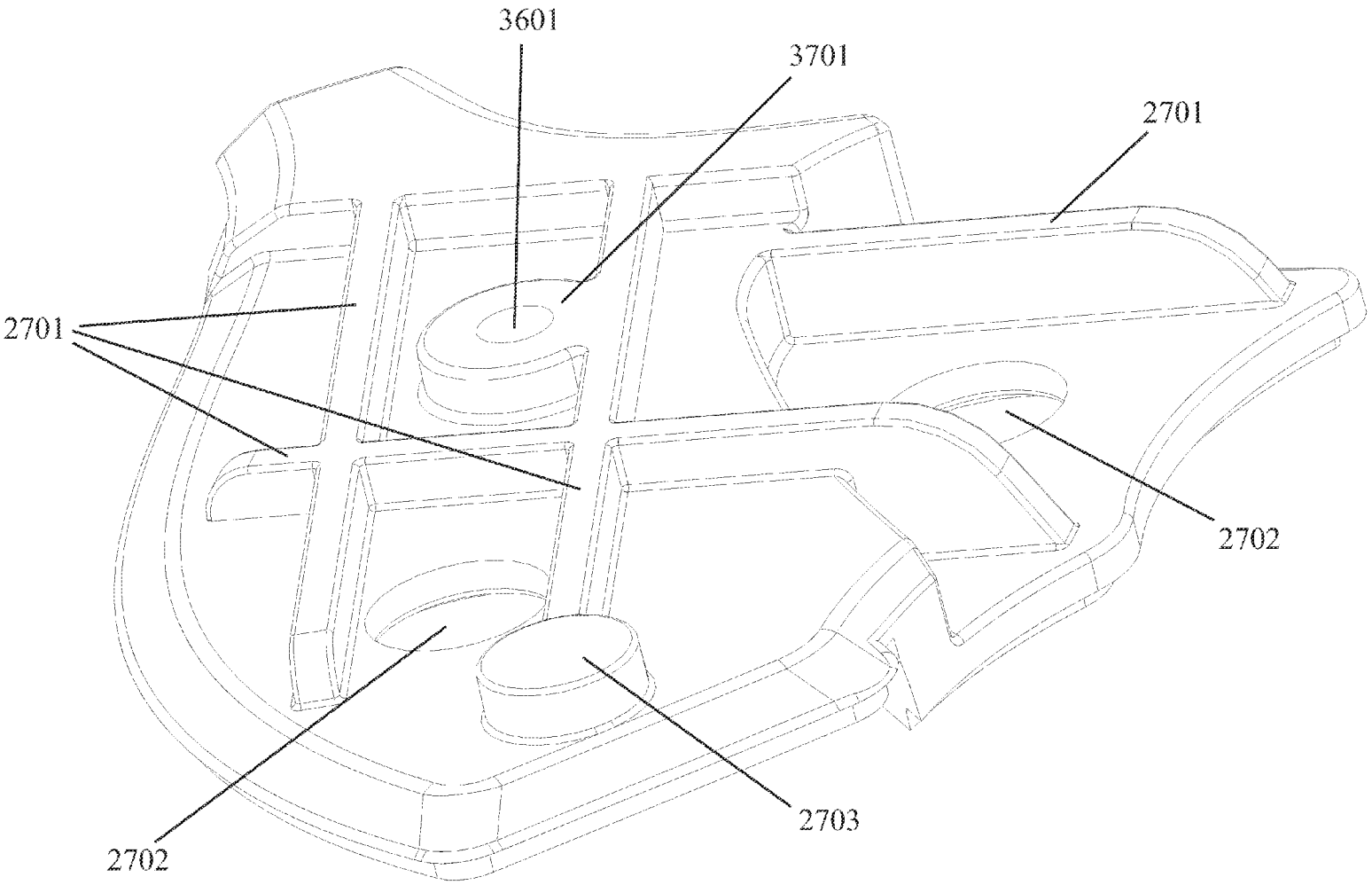
FIG. 43 illustrates a bottom right view of a right substrate for a cone grip in accordance with aspects of the embodiments.
Figure 44:
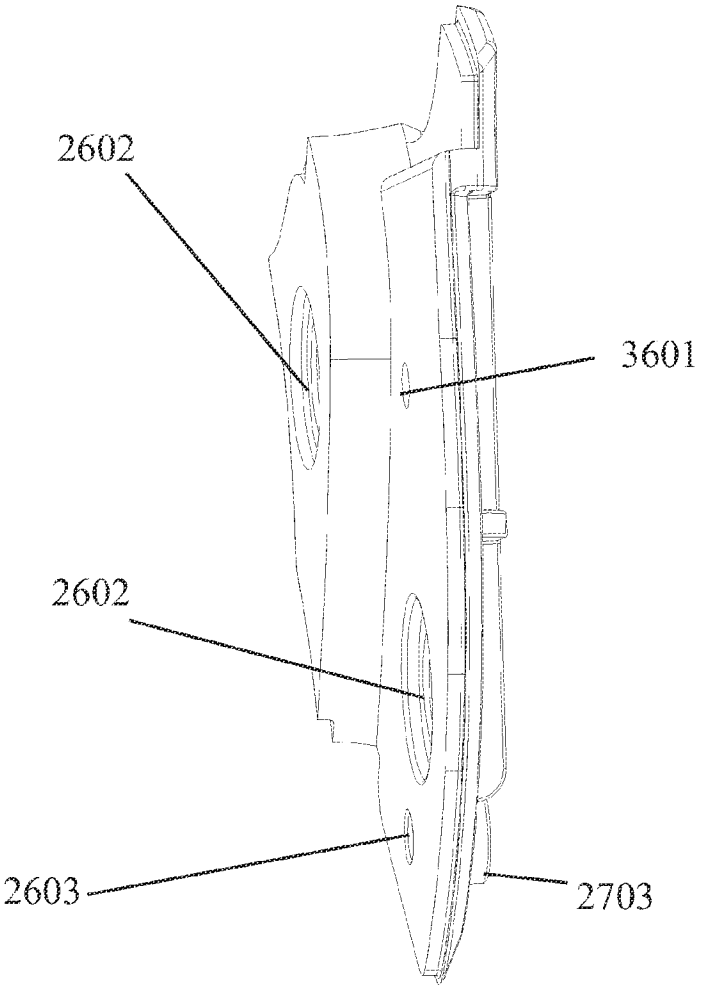
FIG. 44 illustrates a back left view of a right substrate for a cone grip in accordance with aspects of the embodiments.
Figure 45:
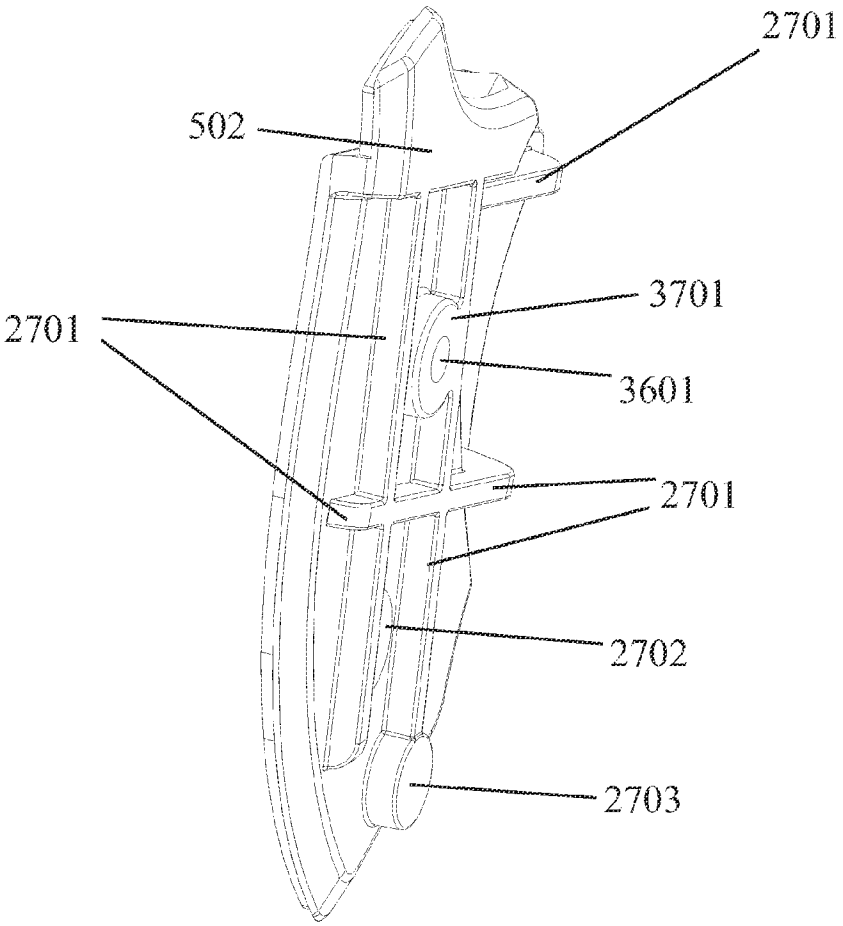
FIG. 45 illustrates a back right view of a right substrate for a cone grip in accordance with aspects of the embodiments.

FIG. 37 illustrates a right side view of a right substrate 502 for a cone grip 102 in accordance with aspects of the embodiments. The hole support 3701 around the screw hole 3601 can be seen.

FIGS. 46-55 illustrate views of a right overmold 103 for a cone grip 102 in accordance with aspects of the embodiments.

Figure 46:
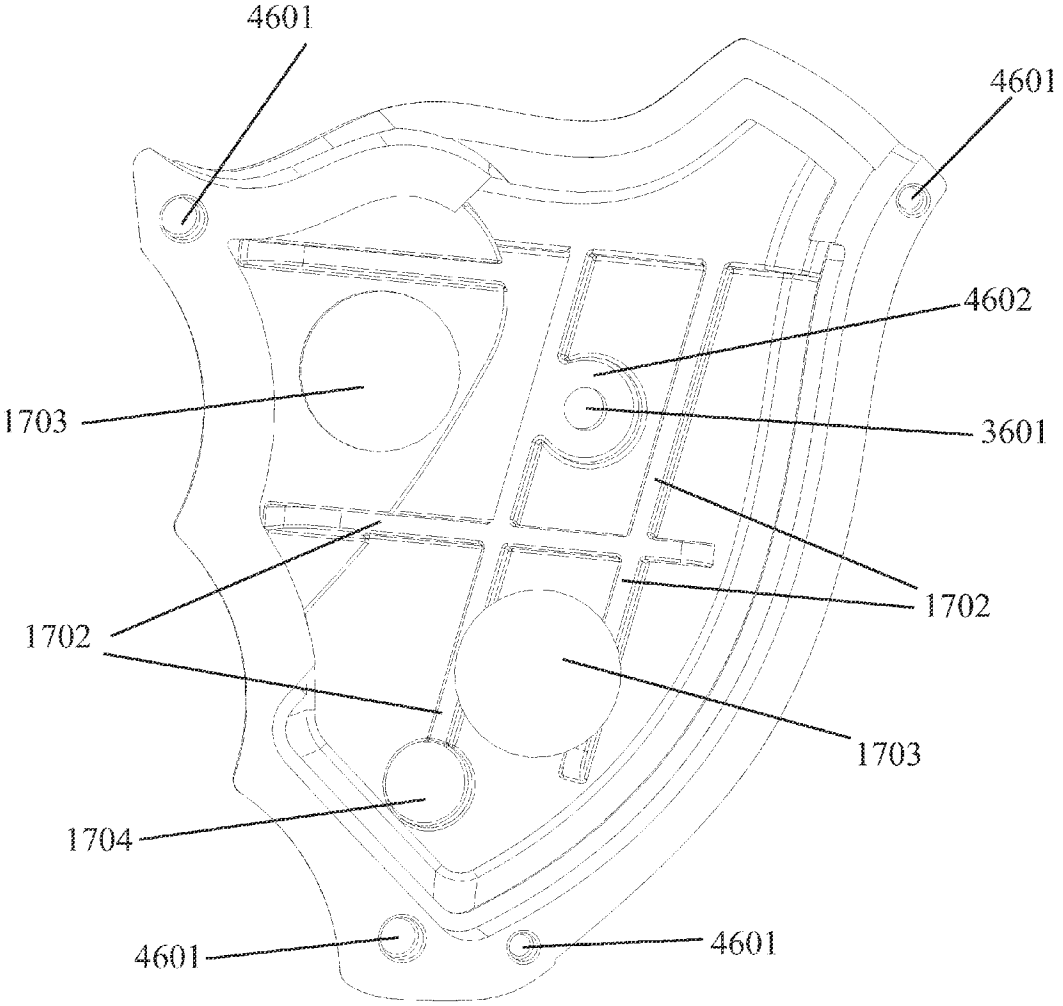
FIG. 46 illustrates a left side view of a right overmold for a cone g p n accordance with aspects of the embodiments.

FIG. 46 illustrates a left side view of a right overmold 103 for a cone grip 102 in accordance with aspects of the embodiments. Most of the illustrated elements and structures are similar to those of the left overmold 201. The right overmold 103 has pin holes 4601 to interface with the left overmold's pins 1701. The right overmold 103 also has a support indent 4602 and a screw hole 3601. The support indent 4602 is formed by overmold material flowing around the hole support 3701 of the right substrate 502. The screw hole 3601 can be molded in a cut later.

Figure 47:
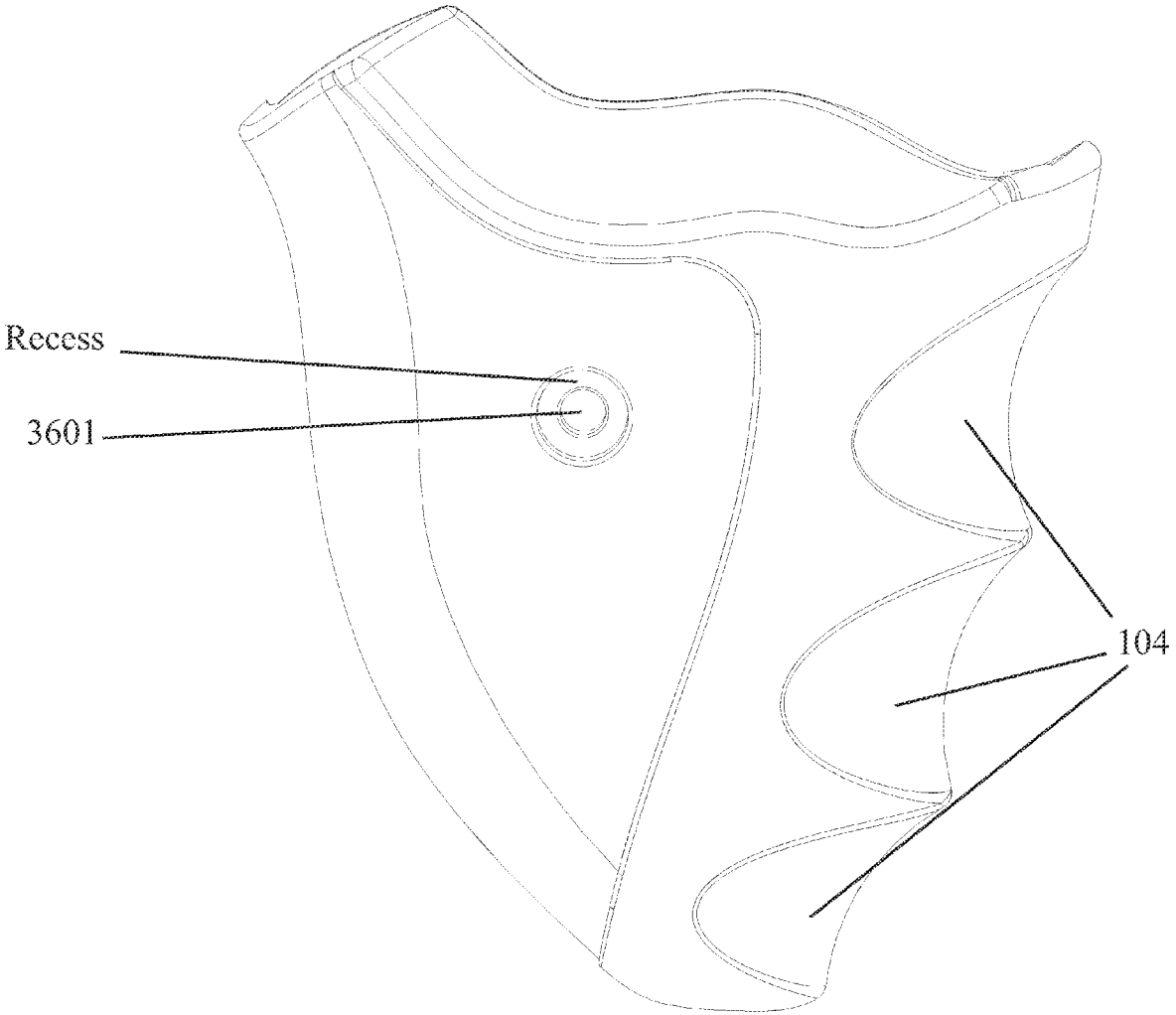
FIG. 47 illustrates a right side view of a right overmold for a cone grip in accordance with aspects of the embodiments.
Figure 48:
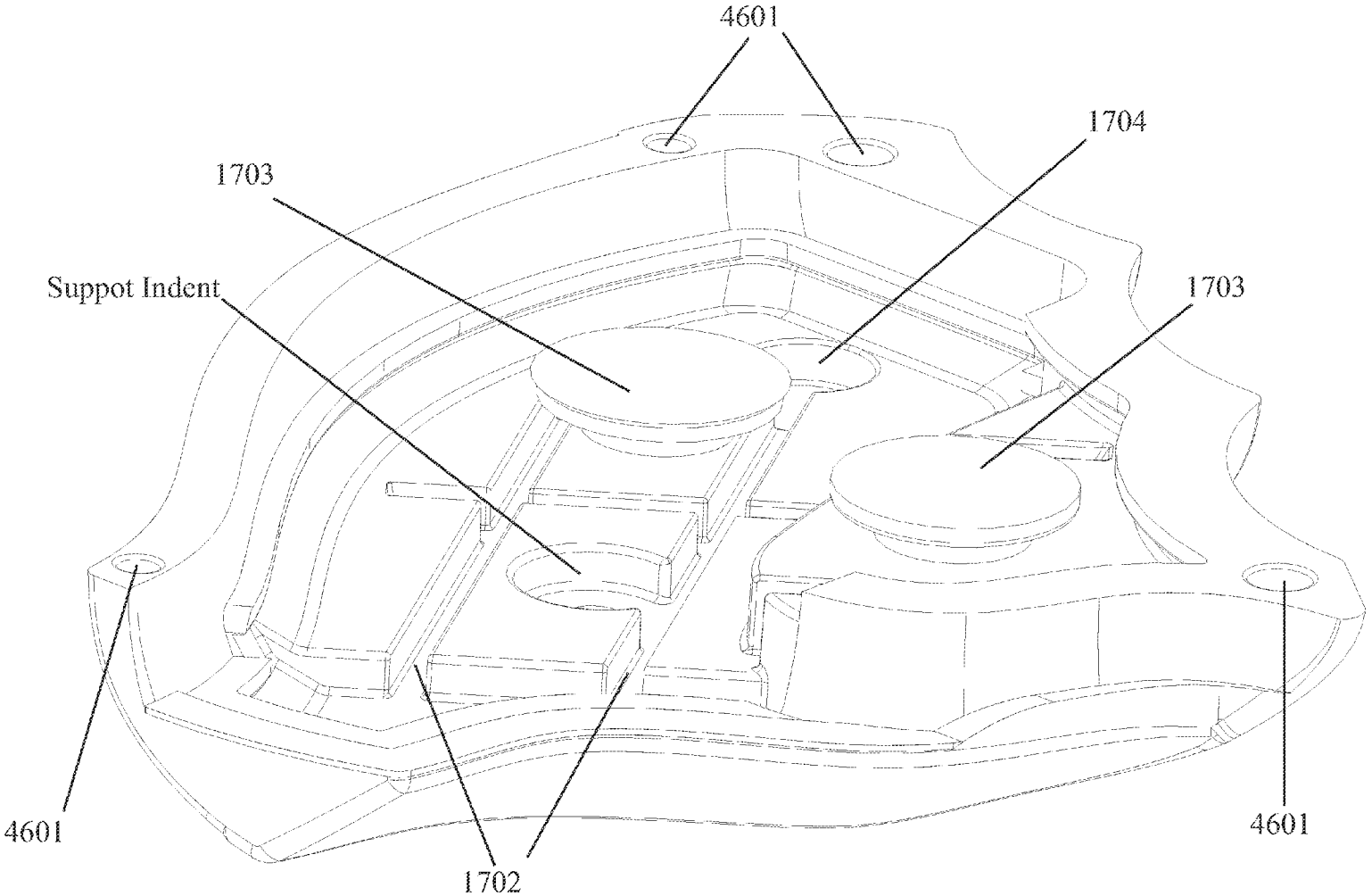
FIG. 48 illustrates a top left view of a right overmold for a cone grip in accordance with aspects of the embodiments.
Figure 49:
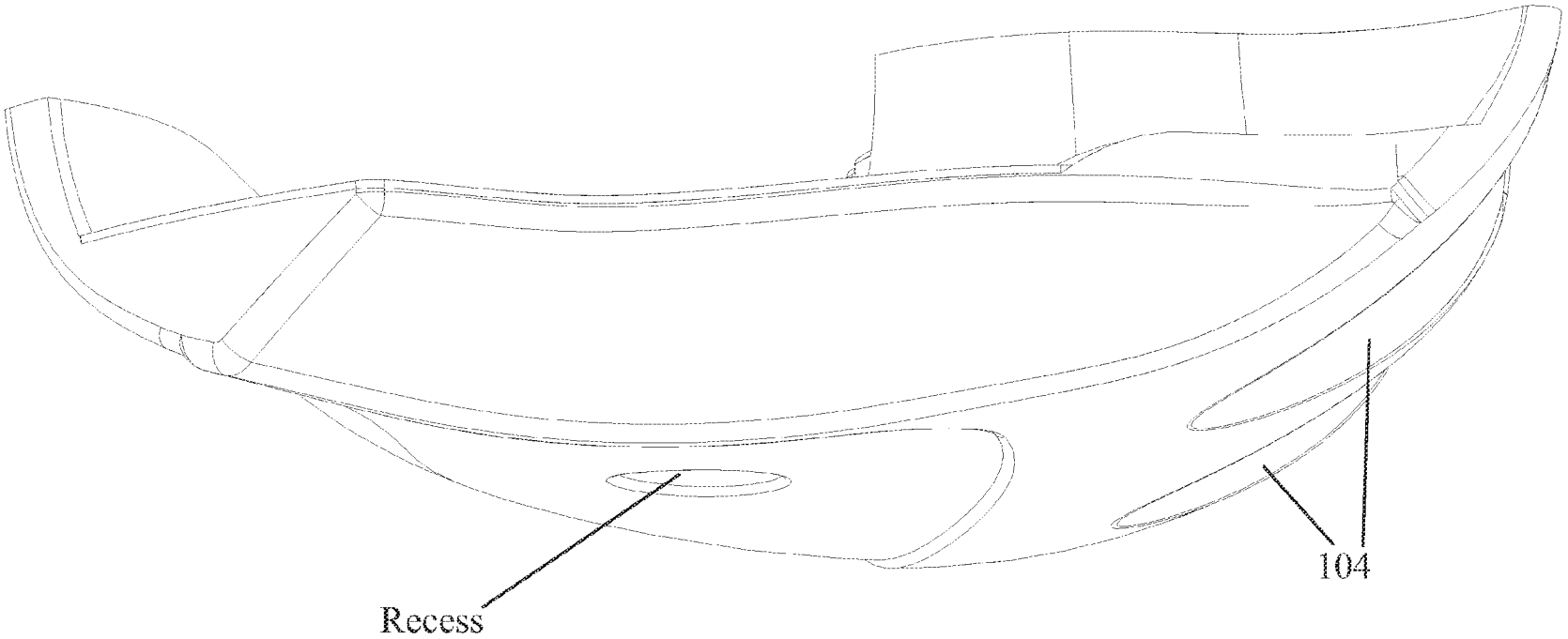
FIG. 49 illustrates a top right view of a right overmold for a cone grip in accordance with aspects of the embodiments.
Figure 50:
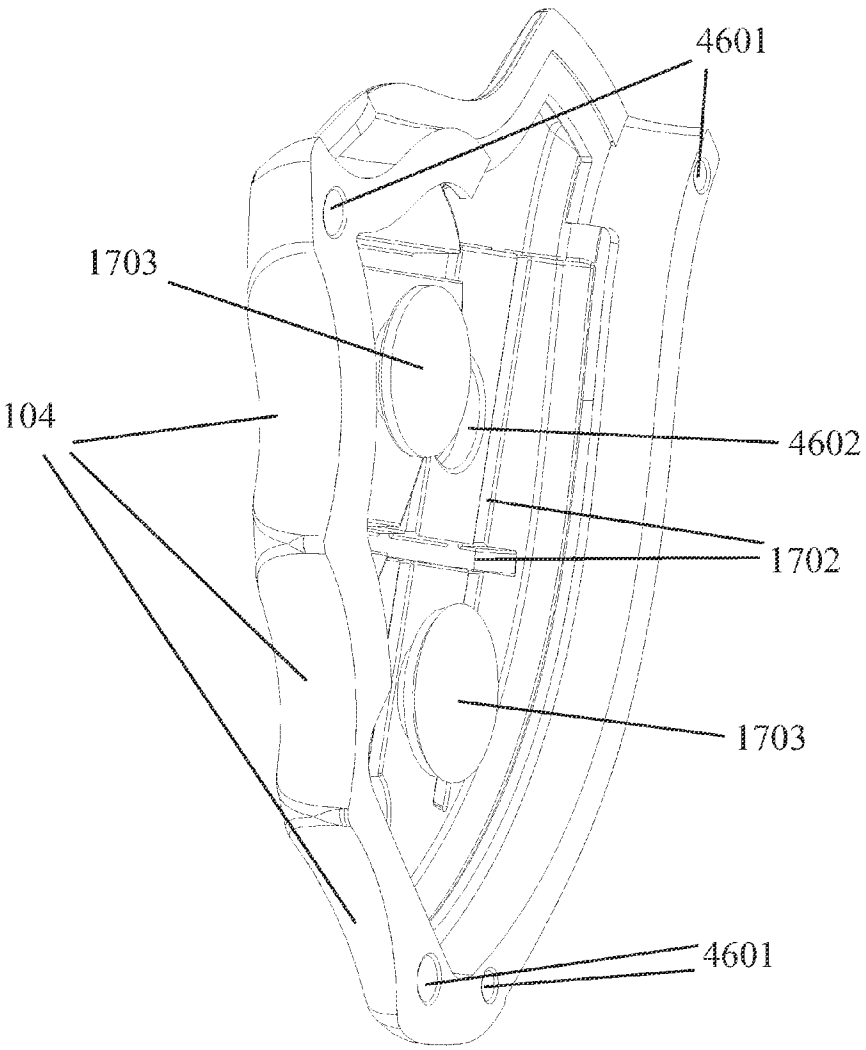
FIG. 50 illustrates a front left view of a right overmold for a cone grip in accordance with aspects of the embodiments.
Figure 51:
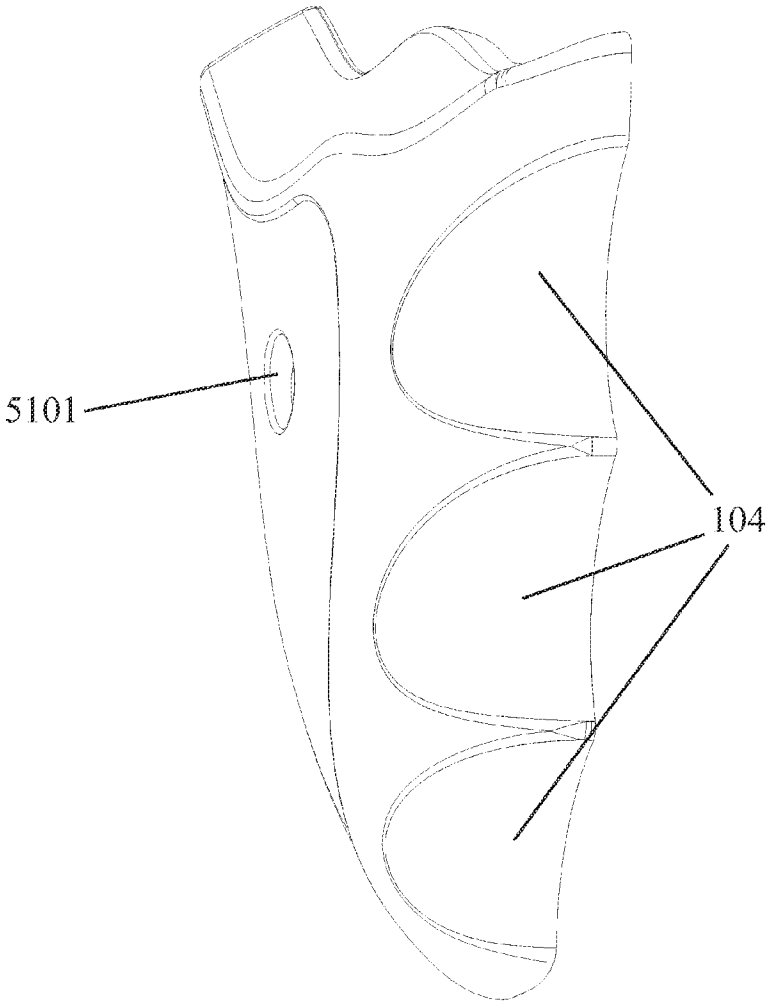
FIG. 51 illustrates a front right view of a right overmold for a cone grip in accordance with aspects of the embodiments.
Figure 52:
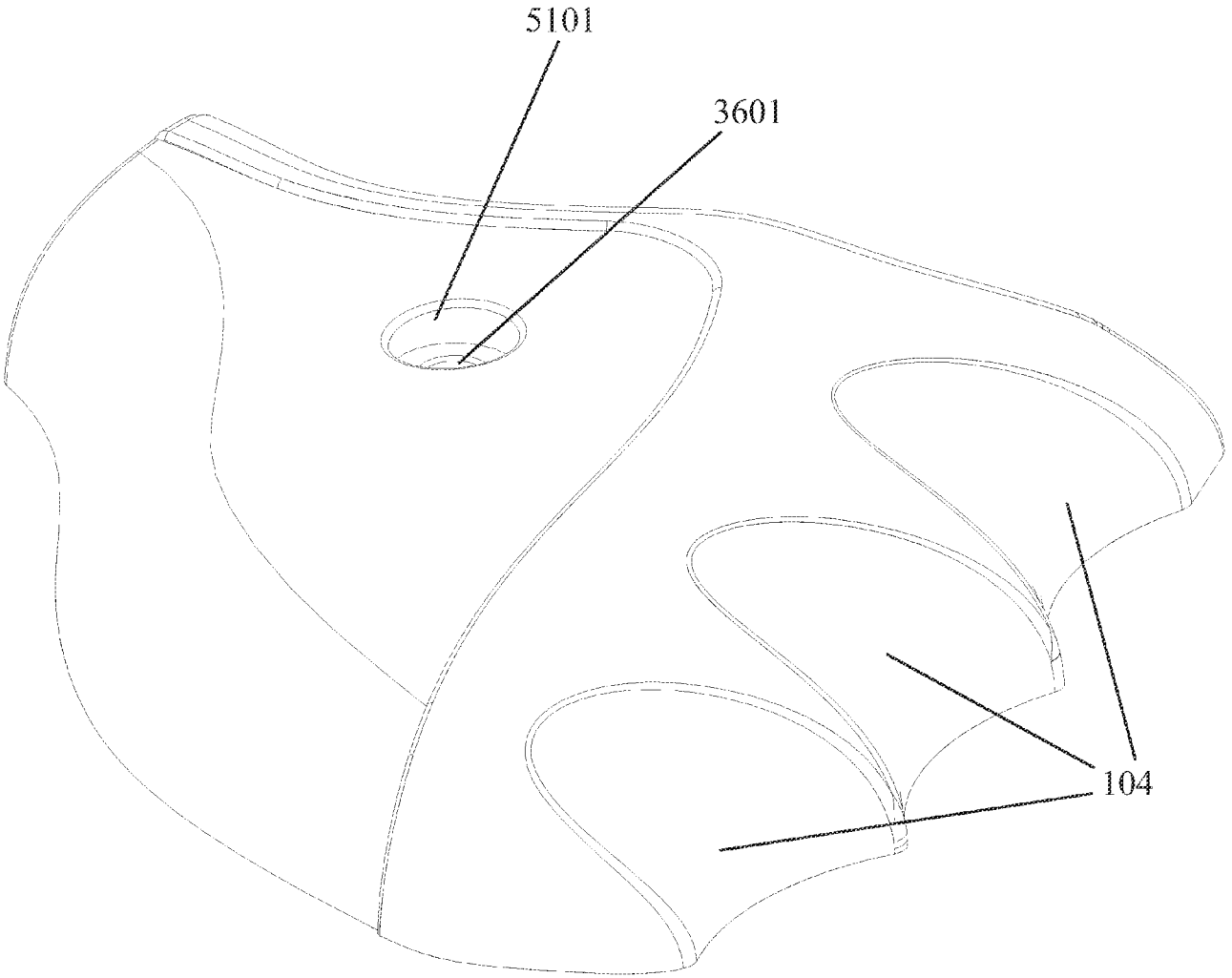
FIG. 52 illustrates a bottom right view of a right overmold for a cone grip in accordance with aspects of the embodiments.
Figure 53:
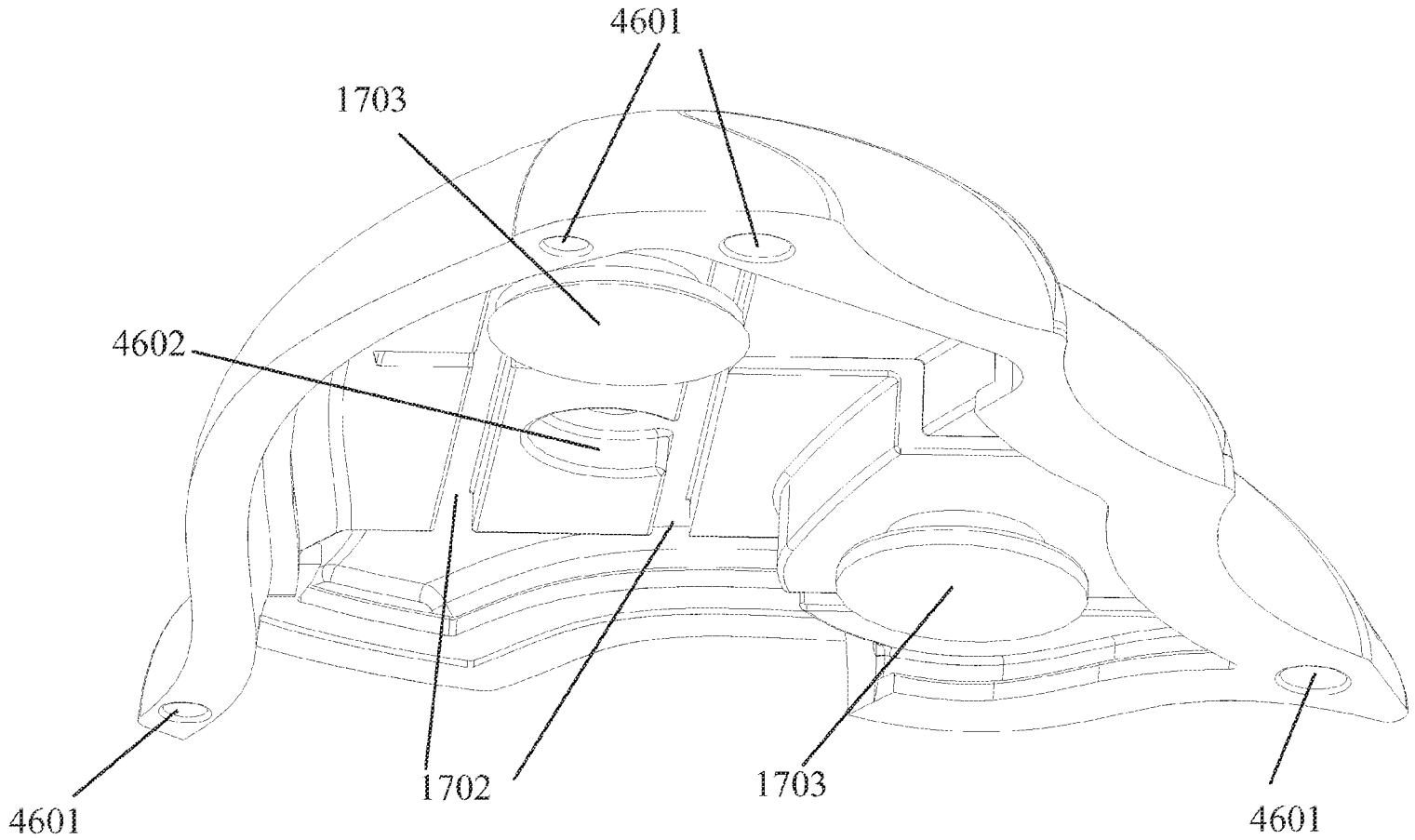
FIG. 53 illustrates a bottom left view of a right overmold for a cone grip in accordance with aspects of the embodiments.
Figure 54:
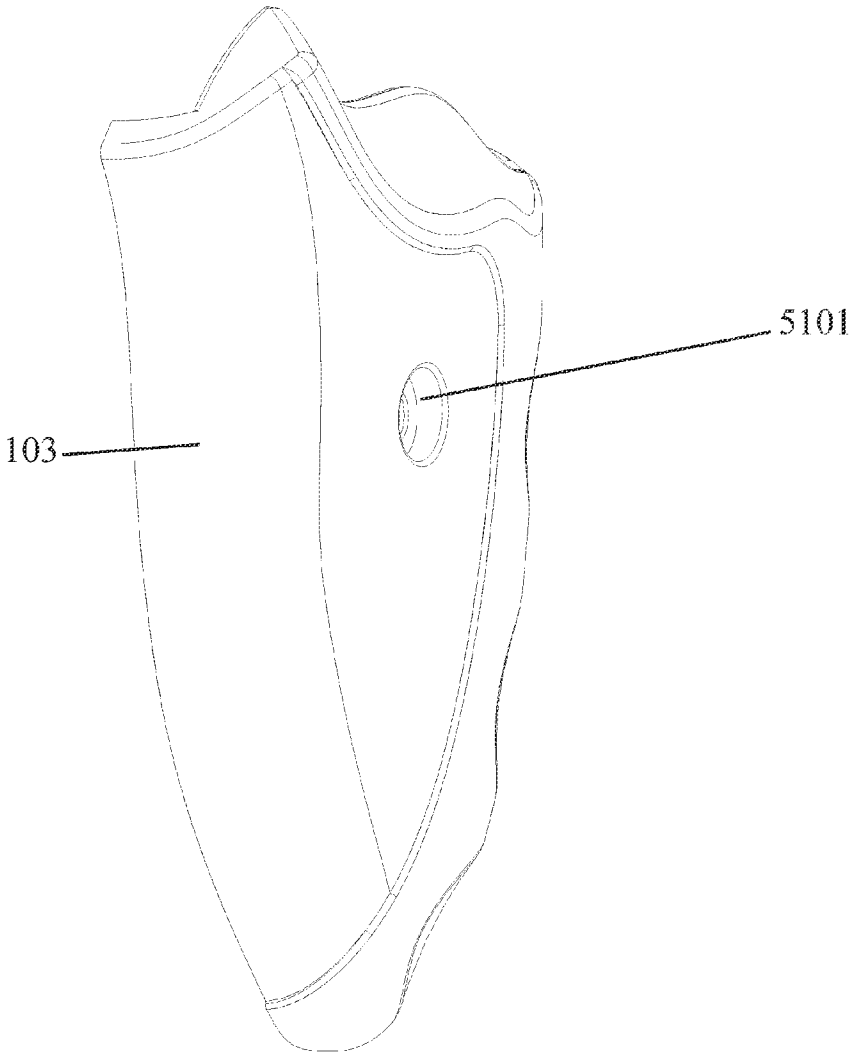
FIG. 54 illustrates a back right view of a right overmold for a cone grip in accordance with aspects of the embodiments.
Figure 55:
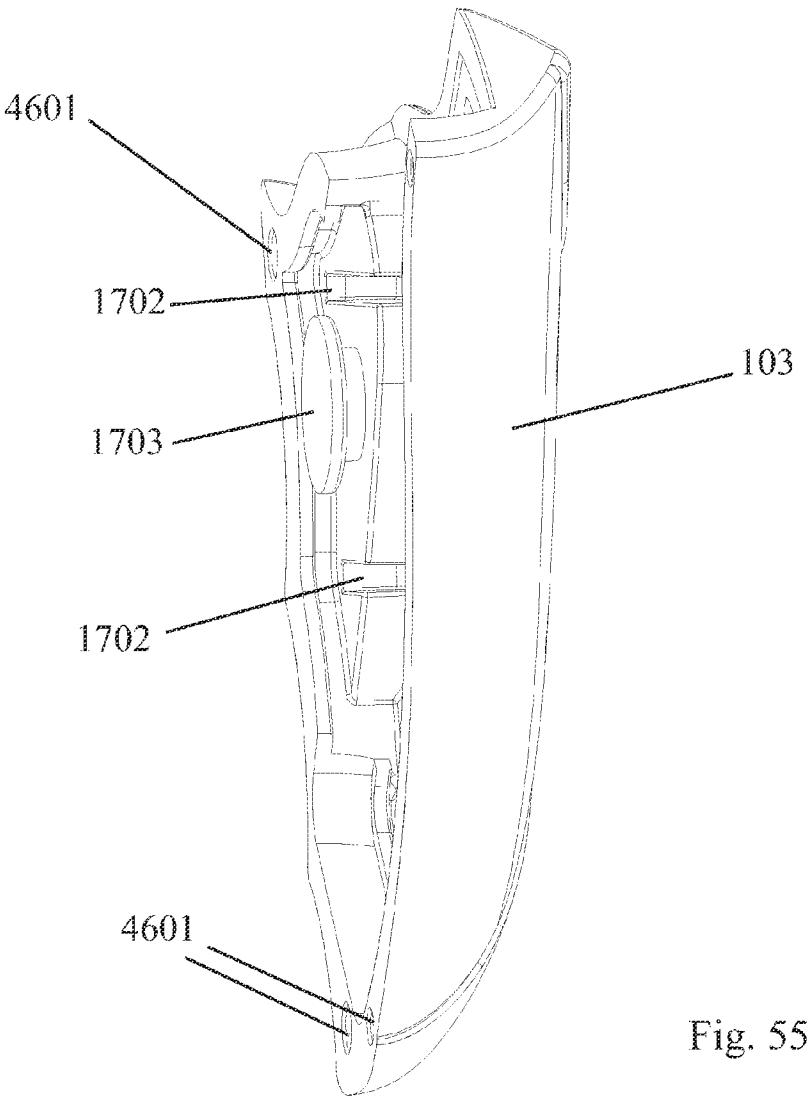
FIG. 55 illustrates a back left view of a right overmold for a cone grip in accordance with aspects of the embodiments.

FIG. 47 illustrates a right side view of a right overmold 103 for a cone grip 102 in accordance with aspects of the embodiments. The head of the machine screw 105 fits fully into the recess 5101 in the right overmold 103 to protect the operator's hand.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A grip for a revolver, the revolver comprising a frame, the frame comprising a trigger guard, and a grip area, the grip area comprising a base, a palm strap, and typical finger interface, the grip comprising:

a left overmold, a left substrate, a right substrate, and a right overmold wherein the left substrate is bonded to the left overmold, wherein the right substrate is bonded to the right overmold, and wherein the grip area fits into the left substrate and into the right substrate such that the grip encompasses the grip area such that the grip is configured to provide a handhold by which a person can hold the revolver;

a finger interface; and a palm interface and wherein the finger interface and the palm interface intersect such that the grip has a substantially conical cross-section.

2. The grip of claim 1 wherein the revolver is configured with a large gap between the typical finger interface and the trigger guard and wherein the grip contacts the trigger guard to thereby fill the large gap.

3. The grip of claim 1 wherein the revolver is configured with a large gap between the typical finger interface and the trigger guard and wherein the grip fills the large gap.

4. The grip of claim 1 further comprising a finger interface forward edge wherein the revolver is configured with a large gap between the typical finger interface and the trigger guard and wherein a finger interface forward edge lies under at least some portion of the trigger guard.

5. The grip of claim 1 further comprising a plurality of finger grooves.

6. The grip of claim 5 wherein at least one of the finger grooves is within the large gap.

7. The grip of claim 5 wherein at least one of the finger grooves lies under the large gap.

8. A grip for a revolver, the revolver comprising a frame, the frame comprising a trigger guard, and a grip area, the grip area comprising a base, a palm strap, and typical finger interface, the grip comprising: a left overmold, a left substrate, a right substrate, and a right overmold wherein the left substrate is molded over the left overmold, wherein the right substrate is molded over the right overmold, and wherein the grip area fits into the left substrate and into the right substrate such that the grip encompasses the grip area such that the grip is configured to provide a handhold by which a person can hold the revolver; and a finger interface and a palm interface that intersect, and are closer together at the grip bottom end than at the grip top end such that the grip has a substantially conical cross-section.

9. The grip of claim 8 wherein the revolver is configured with a large gap between the typical finger interface and the trigger guard and wherein the grip contacts the trigger guard to thereby fill the large gap.

10. The grip of claim 8 wherein the revolver is configured with a large gap between the typical finger interface and the trigger guard and wherein the grip fills the large gap.

11. The grip of claim 8 further comprising a finger interface forward edge wherein the revolver is configured with a large gap between the typical finger interface and the trigger guard and wherein a finger interface forward edge lies under at least some portion of the trigger guard.

12. The grip of claim 11 further comprising a plurality of finger grooves.

13. The grip of claim 12 wherein at least one of the finger grooves is within the large gap.

14. The grip of claim 12 wherein at least one of the finger grooves lies under the large gap.

15. The grip of claim 8 further comprising a plurality of finger grooves.

* * * * *